US007598926B2

(12) United States Patent
Hirata et al.

(10) Patent No.: US 7,598,926 B2
(45) Date of Patent: Oct. 6, 2009

(54) DISPLAY PANEL, CONTROL DISPLAY PANEL AND METHOD FOR INTEGRALLY MOLDING INSERT MATERIAL

(75) Inventors: Junji Hirata, Nara (JP); Yuji Hayakawa, Nara (JP); Akihiro Tsukaguchi, Nara (JP); Ikuhiro Inada, Yamatokooriyama (JP); Masato Matsuda, Nara (JP); Yoshihide Goto, Nagoya (JP); Kiyomi Matsuoka, Inazawa (JP); Kaoru Goto, Aichi (JP)

(73) Assignee: Panasonic Corporation, Osaka (JP)

( * ) Notice: Subject to any disclaimer, the term of this patent is extended or adjusted under 35 U.S.C. 154(b) by 613 days.

(21) Appl. No.: 11/059,586

(22) Filed: Feb. 16, 2005

(65) Prior Publication Data

US 2005/0183305 A1 Aug. 25, 2005

(30) Foreign Application Priority Data

Feb. 17, 2004 (JP) ..... P2004-039446
May 13, 2004 (JP) ..... P2004-143224

(51) Int. Cl.
*G09G 5/00* (2006.01)

(52) U.S. Cl. ..... 345/5; 345/4; 345/7; 345/9; 345/905

(58) Field of Classification Search ..... 345/4, 345/5, 6, 30, 102, 107, 206, 905
See application file for complete search history.

(56) References Cited

U.S. PATENT DOCUMENTS

| | | | | |
|---|---|---|---|---|
| 6,697,039 | B1 * | 2/2004 | Yamakawa et al. | 345/98 |
| 7,333,072 | B2 * | 2/2008 | Yamazaki et al. | 345/5 |
| 2002/0030638 | A1 * | 3/2002 | Weiner | 345/30 |

FOREIGN PATENT DOCUMENTS

| | | | |
|---|---|---|---|
| JP | 5-65329 | | 9/1993 |
| JP | 6-209849 | | 8/1994 |
| JP | 08-267505 | A | 10/1996 |
| JP | 09-083152 | A | 3/1997 |
| JP | 2001-315169 | A | 11/2001 |
| JP | 2003-211487 | A | 7/2003 |
| JP | 2003-231158 | A | 8/2003 |

OTHER PUBLICATIONS

Japanese Office Action.

* cited by examiner

*Primary Examiner*—My-Chau T Tran
(74) *Attorney, Agent, or Firm*—Pearne & Gordon LLP

(57) ABSTRACT

A display panel which is adapted to be mounted on an electronic apparatus, includes a first printed display layer, a transparent material layer that is provided on the first printed display layer, and a second printed display layer that is provided on the transparent material layer so as to correspond to the first printed display layer. The first printed display layer, the transparent material layer and the second printed display layer are integrally formed to each other. The second printed display layer is displayed from the first printed display layer side through the transparent material layer.

14 Claims, 35 Drawing Sheets

100
15
11
13

93
15
11
13
91

93
15
73
93a
13
91
91a

PRIOR ART

DISPLAY PANEL, CONTROL DISPLAY PANEL AND METHOD FOR INTEGRALLY MOLDING INSERT MATERIAL

BACKGROUND OF THE INVENTION

The present invention relates to a display panel, a control display panel and an insert molding method for integrally molding an insert material such as sheet.

Recently, from home electric appliances such as microwave ovens and rice cookers to information equipment such as mobile phones, in the display section of an electronic apparatus, a display panel in which film and resin material are integrally molded is widely used. Some panels are mounted with the switching function section, which is called a membrane switch (sheet switch).

In order to simplify the operation procedures of an electronic apparatus, it is desired that the display panel have a simple configuration. However, accompanying the multi-function tendency in electronic apparatuses, the simpler configuration leads to a more complicated operation. Contrarily, to simplify the operation, when various switches such as a menu key and setting key are disposed in the display panel, a disadvantage that the configuration of the display panel itself becomes complicated results in a high cost. Therefore, in order to employ a display panel with a simple configuration and to simplify the operation thereof, a configuration in which the display area of the display panel, which has a double-layered structure, has been employed to improve the display efficiency within the limited display/operation area.

To form the display area of the display panel into a double-layered structure, a method, in which a printed layer (foil) is formed in an in-molding manner on the front and rear surfaces of a panel base body such as transparent resin having translucency, is available. Thus, by forming the display area of the display panel into a double-layered structure, the density of the information to be displayed is increased and a user-friendly display panel can be obtained.

As a method for integrally molding the printed sheet simultaneously, there is known a method of insert molding, in which a printed sheet printed on the front surface before-hand is placed in dies, and then, a resin material is injected into the dies and pressed; thereby the printed sheet and the resin material are integrally molded (for example, JP-A-6-209849). The insert molding as described above includes a front insertion method, in which the printed sheet is disposed on the front side surface of the molding article, and a rear insertion method, in which a printed sheet is disposed on the rear surface side of a molding article which has translucency.

However, in a process in which the above-mentioned front printed sheet and the rear printed sheet are adhered to the panel base body of a transparent resin or the like using an adhesive, a double-sided adhesive tape or the like, the adhered face between the rear printed sheet and the panel base body is seen from the front side resulting in an undesirable state in appearance. Also, the display panel is illuminated by a light source such as an LED from the rear face side, occasionally, uneven display and/or incorrect display due to leaked light are seen from the front side surface of the display panel. This is caused by the fact that, if there is any gap between the rear printed sheet and panel base body, the light readily leaks therefrom. To prevent uneven display or incorrect display, the both sides of the above are required to be adhered reliably with no gap; and when adhering them, uneven adhesion and inclusion of dust are required to be prevented As a method for integrating the panel base body and the printed sheet with a high tightness of contact, an insert molding is available. However, when the above described display panel is molded employing the insert molding, a problem is caused in any one of the front insertion method and the rear insertion method.

FIG. 36A shows a switch section of a display panel, which is molded by the front insertion method. FIG. 36B is a schematic sectional view showing the display section of the same display panel. In the front insertion method, the light from a light source 4 at the illuminated (ON state) side is transmitted through a translucent portion 3*a* of a printed sheet 3A placed over the front side surface of the display panel 1A. However, because the thickness of the panel base body 6 reaches to the light path length up to the translucent portion 3*a*, a part of the light from the light source 4 reaches to the neighboring translucent portion 3*b*, Since the translucent portion 3*b* allows the light from the light source 5 at the un-illuminated side (OFF state) in FIG. 36B to transmit therethrough, a leaked light is caused. That is, the translucent portion 3*a*, which should not be illuminated, is illuminated. As a result, the light from the neighboring light source is mixed and displayed resulting in an unsatisfactory visibility as the display panel.

On the other hand, FIG. 37A shows a switch section of a display panel molded by the rear insertion method. FIG. 37B is a schematic sectional view showing the display section of the same display panel. In the rear insertion method, a printed sheet 3B is disposed on the rear surface of the display panel 1B. Accordingly, since the printed portion is positioned close to the light source, light leakage is eliminated. Thus, even when the light sources are positioned close to each other, the light can be displayed with no mixture of light. However, on the other hand, when the switch press member 8 is repeatedly depressed to turn the switch 7 ON/OFF, since the depression direction coincides with the direction peeling off the printed sheet 3B from the panel base body 6, the peeling-off of the printed sheet 3B is accelerated.

Further, when the display panel 1B is viewed from the direction "V" in FIG. 37B, since the panel base body 3 is transparent, an engagement unit (including rib, catch, screw hole etc.) 9 for attaching the display panel 1 to the electronic apparatus are seen resulting in a problem in appearance.

Therefore, a display panel in which the printed sheet has a double-layered structure, has been proposed. That is, on the front side surface of the configuration formed by the above-described front insertion method, still another layer; i.e., a transparent material 10 applied with printed sheet 3D over the front surface thereof is overlapped. FIGS. 38A and 38B show examples of the display panel of the double-layered structure. Owing to this configuration, retaining units 9 are concealed by the printed area of the printed sheet 3C; thus the problem in appearance can be eliminated. It is arranged so that the switch operation is made via the printed sheet 3D of the outermost layer; thus the peel-off problem also can be eliminated. However, to join the transparent material 10 to the printed sheet 3D and to join the panel base body 6 to the printed sheet 3C, a total two times of the injection molding process are required. Further, another step to join the molded pieces to each other is required leading to a complicated manufacturing process. Furthermore, the performance of the ink or the like are required to withstand high temperatures for a long period of time. Therefore, this method is hardly put to practical use. Further, in this method also, as shown in FIG. 36B, same as the front insertion method, due to the thickness of the panel base body 6, the problem of light leakage is not eliminated.

Further, as an example of related insert molding methods, there is known an insert molding method in which an adapter secures a resin path (refer to, for example, JP-B-5-065329 (2-3 pages and FIG. 1)).

In an insert molding method disclosed in JP-B-5-065329, a sprue communicating with a cavity is disposed in the central area of the lower die, and on the periphery of the sprue, an adapter is inserted communicating with the cavity so as to come out and retreat. The sprue is supported on a first eject plate, and communicates with a screw extrusion molding machine. The adapter projects above a second eject plate placed on the first eject plate and is supported via a pin. The adapter is located at the cavity side and is equipped with a flange, which is fitted into an annular groove formed in the periphery portion of the sprue. The second eject plate is equipped with a return pin, which penetrates through the lower die, and by engaging with the upper die, the second eject plate is made to retreat, and when the adapter is lowered, the flange is engaged with the inside of the annular groove.

In the insert molding method according to JP-B-5-065329, the adapter secures the resin path and an insert material is also fixed to the adapter. Therefore, the resin supplied to the inside of the cavity flows between the insert materials, and by the injection pressure or the press pressure including the injection pressure, both insert materials are molded into a configuration of the dies. At the same time, the materials are integrated being sandwiched therebetween; thus the molding is completed.

However, the insert molding method according to JP-B-5-065329 has the following problems. That is, although both of the front and rear surfaces of the molded article is covered with the insert material, in a state of the molded article, in which the resin material and the insert material are integrally molded, the insert material is occasionally peeled off; or during molding, the resin material occasionally flows between the die and the insert material. Due to the force of flowing resin material, the insert material is occasionally warped within the molding dies; thus, the desired configuration is hardly molded stably.

SUMMARY OF THE INVENTION

The present invention has been proposed in view of the above-described problems. A first object of the present invention is to provide a display panel, which is simple in structure, capable of simplifying the operation and has a high durability without causing any problem in appearance, and a control display panel equipped therewith.

Further, a second object of the present invention is to provide an insert molding method capable of stably molding into a desired configuration by integrally molding a sheet reliably.

The above object is achieved by the following configuration.

A display panel which is adapted to be mounted on an electronic apparatus, comprising:

a first printed display layer;

a transparent material layer that is provided on the first printed display layer; and a second printed display layer that is provided on the transparent material layer so as to correspond to the first printed display layer, wherein the first printed display layer, the transparent material layer and the second printed display layer are integrally formed to each other; and wherein the second printed display layer is displayed from the first printed display layer side through the transparent material layer.

According to the display panel, a display with depth and translucency, in which the second printed display layer is displayed from the first printed display layer through the transparent material layer, can be achieved with a simple configuration.

Preferably, the first printed display layer is a first printed sheet which includes a base having translucency and a first printed area formed on the base.

According to the display panel, by utilizing the first printed display layer as a first printed sheet, the durability of the printed display layer is increased by the sheet material.

Preferably, the second printed display layer is a second printed sheet which includes a base having translucency and a second printed area formed on the base.

According to the display panel, by utilizing the second printed display layer as a second printed sheet, the durability of the printed display layer is increased by the sheet material.

Preferably, the first printed display layer is a first printed sheet which includes a base having translucency and a first printed area formed on the base. The second printed display layer is a second printed sheet which includes a base having translucency and a second printed area formed on the base. The transparent material layer has a first through hole. The second printed sheet has a second through hole which is communicated with the first through hole. The first printed sheet has a single sheet layer at an area corresponding to the first through hole.

According to the display panel, at the position of the through holes, by forming the first printed sheet in a single sheet layer, the first printed sheet can be functioned as a switching operation section which operates by being depressed. Further, the first printed sheet is not peeled off from the transparent material layer due to the depressing operation.

Preferably, the area of the single sheet layer in the first sheet is subjected to an embossment processing.

According to the display panel, by processing the area of the single sheet layer into an embossment, a state that the sheet locally swells outward is obtained, and the portion processed into the embossment appears as if floating in three-dimensional space. Owing to this, the design performance of the display panel is increased and the portion processed into the embossment is readily recognized visibly.

Preferably, at least a part of the first printed area is processed with a medium printing having a light diffusion feature.

According to the display panel, since the medium printed area diffuses and transmits the irradiated light, only the printed area thereof is illuminated; the visibility can be increased.

Preferably, at least a part of the second printed area is processed with a medium printing having a light diffusion feature.

According to the display panel, the medium printed area diffuses and transmits the irradiated light. Accordingly, only the printed area can be illuminated increasing the visibility. Further, the rear face side of the display panel is prevented from being seen from the front surface side.

Preferably, an engagement portion for fixing the display panel is formed at a periphery of the transparent material layer. The first printed area of the first printed sheet has an opaque area that is arranged so as to correspond to the engagement portion.

According to the display panel, by disposing the first printed area to the position opposite the engagement portion, the engagement portion is not seen from the display side of the display panel. Thus, no problem in appearance arises.

Preferably, the first printed display layer is a first printed sheet that includes a base having translucency and a first printed area formed on the base. The second printed display layer is a second printed sheet that includes a base having translucency and a second printed area formed on the base. A bended portion, in which an end portion of at least one of the first printed sheet and the second printed sheet is extended from a surface of the transparent material layer toward a side end surface of the transparent material layer, is formed on at least a part of a periphery of the transparent material layer.

According to the display panel, the bended portion is formed in which the printed sheet is bended to the side end surface of the transparent material layer. Owing to this, in the insert molding process, in which precise aligning between the sheet end and the end portion of the transparent material layer is difficult to carried out, it is possible to prevent the sheet from sticking out of the end portion of the transparent material layer and a cutting process in the case of sticking out of the sheet can be eliminated.

Preferably, the first printed display layer is a first printed sheet that includes a base having translucency and a first printed area formed on the base. The second printed display layer is a second printed sheet that includes a base having translucency and a second printed area formed on the base. A rib portion is provided on a periphery of the transparent material layer so as to protrude toward the second printed sheet side. A surface of the rib portion is connected to a surface of the transparent material layer. A bended portion, in which an end portion of at least one of the first printed sheet and the second printed sheet is extended from a surface of the transparent material layer toward a side end surface of the transparent material layer, is formed on at least the surface of the rib portion.

According to the display panel, by extending the printed sheet to the front surface of the rib to provide the bended portion, alignment accuracy for placing the sheet to the die can be alleviated. Accordingly, the productivity is increased and the cost thereof is reduced.

Preferably, the first printed display layer is a first printed sheet that includes a base having translucency and a first printed area formed on the base. The second printed display layer is a second printed sheet that includes a base having translucency and a second printed area formed on the base. A projection portion is provided on the transparent material layer. An opening portion is provided on at least one of the first printed sheet and the second printed sheet so as to expose the projection portion through the opening portion. A bended portion, in which an end portion of a periphery of the opening portion of at least one of the first printed sheet and the second printed sheet is extended along a side surface of projection portion of the transparent material layer, is formed at a periphery of the projection portion of the transparent material layer.

According to the display panel, by extending the printed sheet to the periphery of the convex portion, the end portion of the printed sheet can be readily processed.

According to the present invention, there is also provided a control display panel, comprising:

the display panel;

a switch pressing member that is disposed in the first and second through hole; and a switching unit that performs a switching operation by receiving an operation in which the switch pressing member is depressed through the single sheet layer of the first printed sheet.

According to this control display panel, by depressing the switch pressing member via the printed sheet layer, the switching operation is carried out.

Preferably, the first printed area of the first printed sheet has an opaque area.

According to this control display panel, by forming the opaque printed area, a state is reached as if the area of the single sheet layer is floating in three-dimensional space. Thus, the visibility is enhanced and the operational performance is also increased.

According to the present invention, there is also provided a control display panel, comprising:

the display panel, and a light source that is disposed at the second printed sheet side of the display panel, wherein the second printed area is formed on the second printed sheet so as to correspond to an irradiation position of the light source; and wherein the second printed area includes an area processed with a medium printing having a light diffusion feature.

According to this control display panel, by selectively irradiating the light from the light source to a specific area of the second medium printed sheet, the irradiated area is illuminated; thus, the display with high visibility can be achieved. Further, the component of the returned. light, which has passed through the display panel, is not reflected again nor returned to the display side. Accordingly, each of the medium printed areas to be selectively displayed can be disposed in a narrower area. Owing to this, a display of higher density is made possible resulting in an increased operation performance.

Owing to the display panel according to the present invention, a display panel, which has a simple structure and is easy to operate and has a high durability without causing any problem in appearance, and a control display panel, which, by using the display panel, provides the above-described effects, are obtained.

Further, according to the present invention, there is also provided an insert molding method, comprising providing an upper die and a lower die which is disposed so as to face to the upper die;

providing a sheet member which is disposed in a cavity formed by the upper die and the lower die; and ejecting a resin material to an extended portion of the sheet that is extended out of the cavity so as to fill an inside of the cavity with the resin material to form a molded article integrated with the sheet.

Preferably, a gate for ejecting the resin material is formed above the extended portion of the sheet.

Preferably, the insert molding method further includes a cutting process for cutting a part of the molded article with the extended portion.

According to the insert molding methods, the gate for filling the resin material is formed above a part of the sheet extended from the cavity. Accordingly, since the molding is carried out while pressing the sheet with the gate, the sheet is integrally molded while being positioned reliably with no peel-off or warp. Thus, the sheet can be stably molded into a desired configuration.

Preferably, a width of the extended portion of the sheet is larger than a diameter of the gate.

According to the insert molding method, since the width of the extended portion of the sheet is formed wider than the width of the gate, the pressure force by the gate can be received evenly and stably.

Preferably, the gate is disposed at substantially center of the extended portion as viewed in a direction in which the resin member is ejected from the gate.

According to the insert molding method, the pressure force by the gate can be applied to an extended portion of the sheet extended up to the both sides of the gate. Accordingly, even when the temperature of the filled resin material is high, the accuracy of the sheet positioning can be improved.

Preferably, the sheet is disposed at both sides in the cavity.

According to this insert molding method, by disposing the sheets on the both sides inside the cavity, a double-faced insert molding, in which two sheets disposed on the both sides of the cavity are integrally molded reliably, can be carried out.

Preferably, the molded article is a control panel having a switch unit.

According to the insert molding method, when a molded article is used for a control panel having a switch, since the sheet is integrally molded reliably, the control panel molded into a stable configuration can be formed.

According to the insert molding method of the present invention, problems such that the sheet is peeled off and warped and is hardly molded stably into a desired configuration can be eliminated. Thus, since the sheet can be integrally molded reliably, an effect that the sheet can be stably molded into a desired configuration is obtained.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE PREFERRED EMBODIMENTS

Hereinafter, preferred embodiments of a display panel and a control display panel according to the present invention will be described in detail with reference to the drawings.

Figure 1:
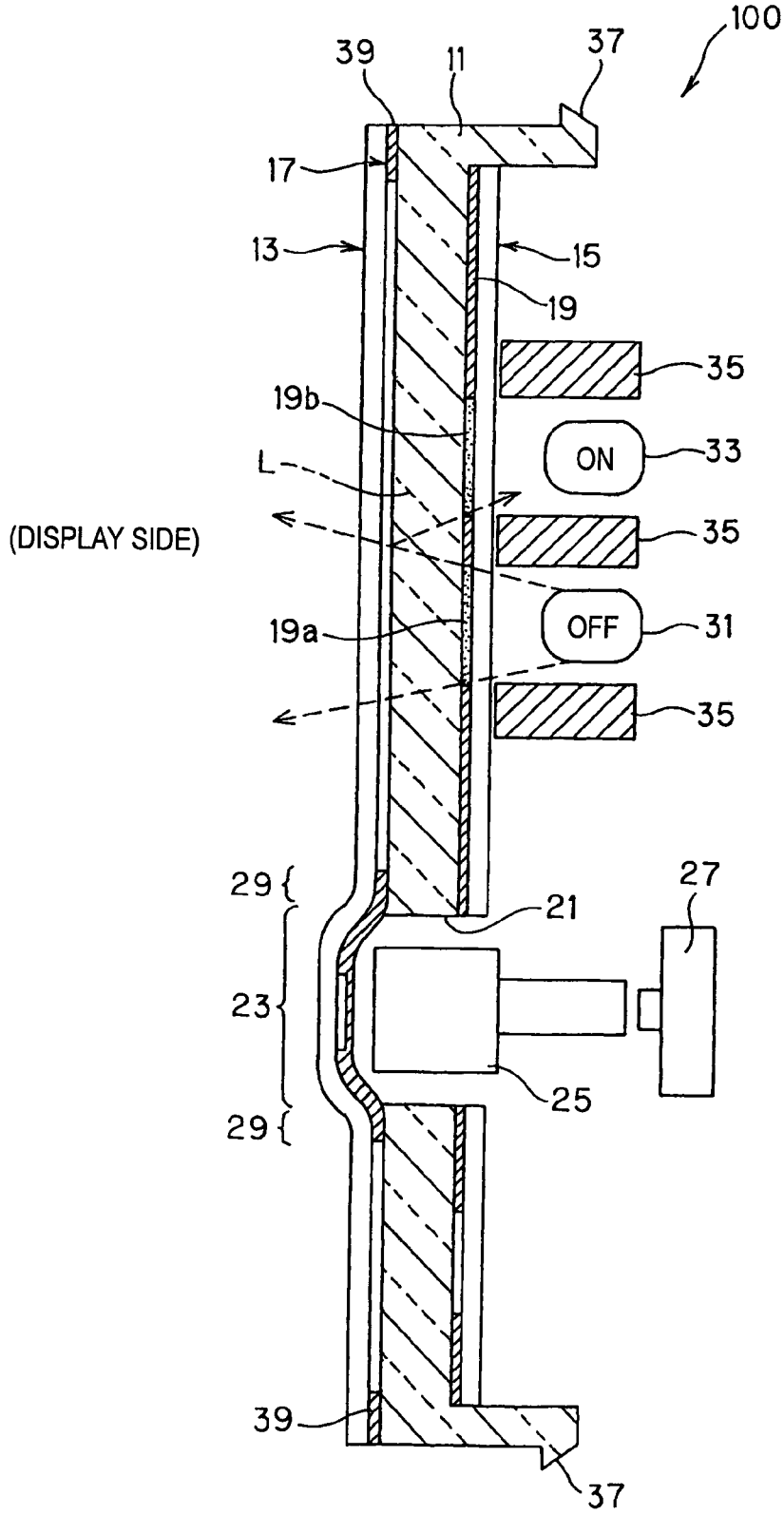
FIG. 1 is a sectional view schematically showing a configuration of a display panel according to the present invention for illustrating the characteristics thereof.

FIG. 1 is a schematic sectional view of a structure for illustrating the characteristics of a display panel according to a first embodiment of the present invention.

A display panel 100 is mounted on an electronic apparatus. The display panel 100 mainly includes a panel base body 11 formed of a translucent material such as transparent resin, a printed sheet (referred to as front sheet) 13 which serves as a first printed display layer adhered to the front side surface of the panel base body 11 and a printed sheet (referred to as rear sheet) 15 which serves as a second printed display layer adhered to the rear side surface thereof. The display panel 100 is an insert-molded article, in which the front sheet 13 and the rear sheet 15 are integrally molded being opposed to each other with the panel base body 11 sandwiched therebetween.

The front sheet 13 is a sheet having a transparent tone, which is printed on a part of a translucent base, and is integrally formed with a printed layer 17 disposed on the front surface at the panel base body 11 side. On the other hand, the rear sheet 15 having opaque tone, which is color printed, is integrally formed with a printed layer 19 disposed on the front surface at the panel base body 11 side.

The panel base body 11 is formed of a transparent material such as ABS resin, polycarbonate resin or acrylic resin. The front sheet 13 and the rear sheet 15 are formed of a sheet using a transparent base such as PET (polyethylene terephthalate) resin of approximately 0.05 to 0.3 mm in thickness.

The printed layer 19 of the rear sheet 15 is arranged so as to be displayed through the panel base body 11 from the front sheet 13 side. According to the display panel 100 like this embodiment, the printed layer 19 of the rear sheet 15 is viewed through the translucent panel base body 11 and the front sheet 13. Accordingly, the display with a quality sense of depth and translucency, in which the printed layer 17 of the front sheet 13 is disposed at the front side and the printed layer 19 of the rear sheet 15 is disposed at the rear side, is presented. When the thickness of the panel base body 11 is 1 mm or more, the quality sense of transparency is further enhanced. That is, shadows on the printed layer 17 such as characters and/or images given to the front sheet 13 are reflected on the rear sheet 15 through the panel base body 11. Owing to this, since the characters and the images are represented three-dimensionally, the characters and images become conspicuous and the design performance is increased. Thus, the depth and translucency are further enhanced. Additionally, being integrally formed, the degree of adhesion among the front sheet 13, the rear sheet 15 and the panel base body 11 is increased; and the light is accordingly transmitted evenly. Thus, the display with a stable quality and a quality sense of translucency is obtained.

In a part of the panel base body 11 and the rear sheet 15, a through hole 21, which penetrates both of the panel base body 11 and the rear sheet 15 at the same position, is formed. The front sheet 13 is formed in a single sheet layer in an area 23 corresponding to the through hole 21. The area 23 of the front sheet 13 is subjected to an embossment processing to form a swell toward the outside of the panel. A switch press member 25 is received in the through hole 21. When the switch press member 25 is depressed via the area 23 (referred to as embossed portion) of the front sheet 13, the switch 27 is switched over between ON and OFF base on the depressing operation.

The embossed portion 23 is formed by, when molding the display panel 100, pressing a convex-shaped die against the front sheet 13 to plastically deform the front sheet 13. By deforming from a convex shape to a flat or concave shape, the embossed portion 23 functions as a button switch. The portion of the embossed portion 23 and the portion of the external periphery of the embossment 29 of the front sheet 13 are color processed by printing so that the switch press member 25 and the switch 27 are not viewed from the outside of the display panel 100.

Also, the embossed portion 23 appears as if floating on the front sheet 13 in a three-dimensional manner. Accordingly, the design performance of the display panel 100 is enhanced resulting in an increased visibility of the embossed portion 23.

Light sources 31 and 33 such as LEDs are disposed at the rear sheet 15 side of the display panel 100. The light sources 31 and 33 are separated from the display panel 100. Areas 19*a* and 19*b* of the rear sheet 15 corresponding to the irradiation positions of the light sources 31 and 33 are subjected to a medium printing so as to be imparted with a light diffusion feature. The medium printing is a method of printing using ink without pigment. When the medium printed areas 19*a* and 19*b* are illuminated by the light from the light sources, the light is transmitted while being diffused and emitted from the entirety of the medium printed areas. Area other than the medium printed areas are further subjected to a shielding print over the printed layer to prevent the light from the light sources from being transmitted. Further, it may be preferably arranged so that each of the light sources 31 and 33 are partitioned by partitioning walls 35 to avoid interference by the irradiation light and the influence of outside light.

When the light source 31 is lit (ON), and the light source 33 is turned out (OFF), the entirety of the medium printed area 19*a* facing the on-state light source 31 is illuminated brightly. On the other hand, when the medium printed area 19*b* is facing the off-state light source 33, only the reflected light of the light from the display surface side can be seen. That is, by selectively turning ON/OFF the light sources 31 and 33, the medium printed areas 19*a* and 19*b* can be selectively illuminated. Accordingly, for example, the status of an electronic apparatus mounted with the display panel 100 can be displayed.

The light outputted from the light source 31 may be reflected by the boundary face of the panel base body 11 into returned light L. But the returned light L is never reflected again or returned to the display side. Accordingly, even when the light sources 31 and 33 are disposed adjacent to each other, no leaked light is displayed. Thus, a high quality display is obtained.

In the end portion of the display panel 100, engagement catches 37 as an engaging unit for fixing the display panel 100 to an object to be attached such as an electronic apparatus are formed integrally. Therefore, if the front sheet 13 is transparent, since the panel base body 11 is also transparent, the following problem arises; i.e., engagement catches 37 may be seen from the display side. Therefore, the front sheet 13 has a printed area 39, which is colored so as to be opaque, in at least the area corresponding to the engagement catches 37. The printed area 39 conceals the engagement catches 37 of the panel base body 11 from the display side. Accordingly, the problem in appearance is eliminated. And further, since the outer periphery area is framed by the printed area 39, satisfactory design performance is obtained and the portions not to be displayed can be concealed without any sense of strangeness.

Next, an example in which the above-described display panel 100 is mounted to a microwave oven as an electronic apparatus will be described.

Figure 2:
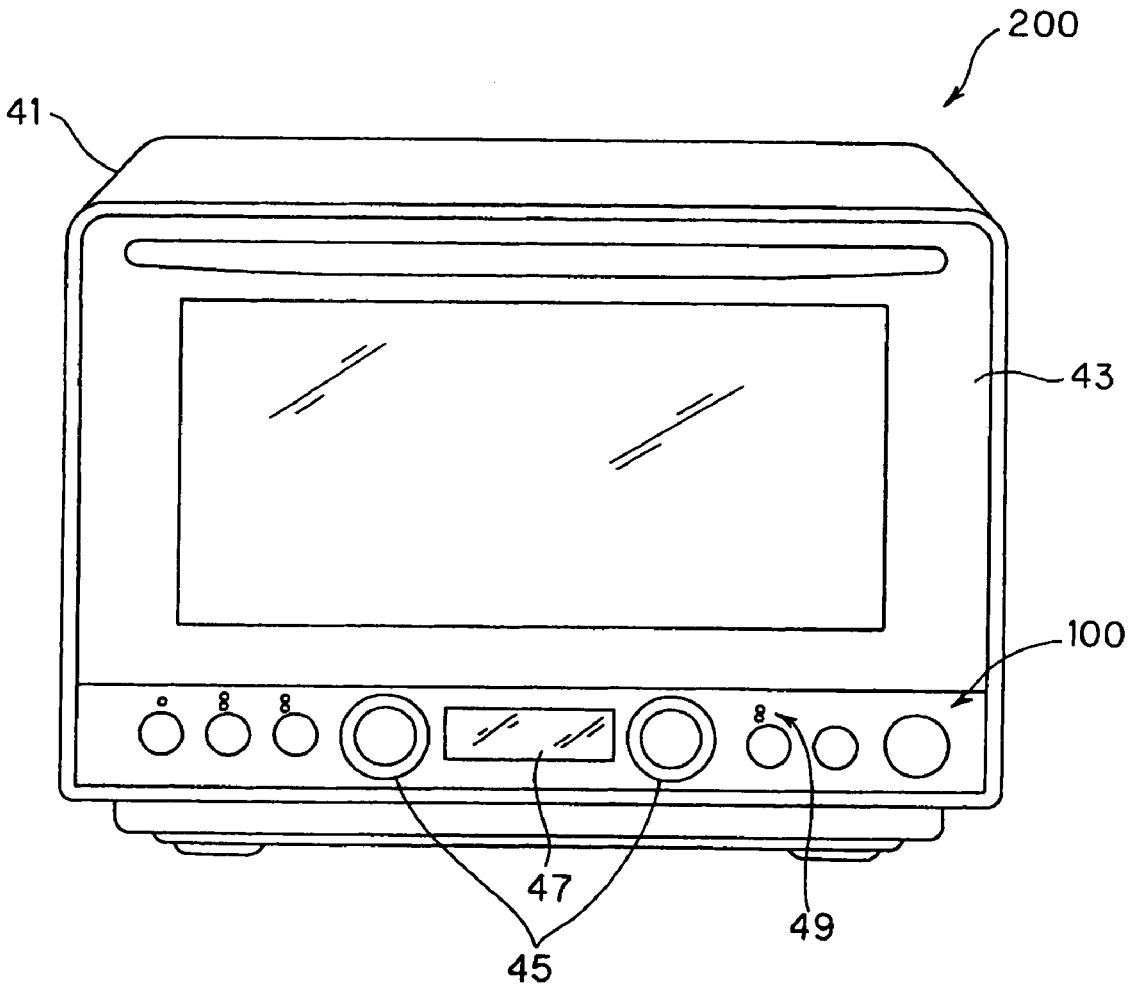
FIG. 2 is a front view of a microwave oven to which the display panel is mounted.

FIG. 2 is a front view of a microwave oven mounted with a display panel according to the present invention.

A microwave oven 200 is a heat cooking apparatus. which supplies high frequency waves (micro waves) or the like to a heat chamber for receiving an object to be heated to process the object by heat. The heat chamber is formed inside a box-like shaped main body case 41 with a front face opened. An open/close door 43 for opening and closing to put in/take out the object to be heated from the heat chamber is provided to the front face of the main body case 41. The open/close door 43 is connected to the lower edge of the main body case 41 at the lower end thereof by hinges so as to be freely pulled out in front to open and pushed in to close. In the lower portion of the open/close door 43, the display panel 100 according to the present invention is mounted.

In this case, the display panel 100 also serves as an operation panel equipped with menu keys and the like for the microwave oven 200. In addition to the various kinds of operation switches such as a start key for indicating start of heating, a manual mode cooking key, an automatic-cooking key for selecting a prepared cooking program, knobs 45, for setting temperature, time or the like, a display section 47 for displaying setting conditions on a liquid crystal display device or the like, light source 49 of a notifying unit for notifying a set menu, operation step and the like are provided. The display panel 100 is attached to the apparatus by the engagement catches 37 at the lower portion under the open/close door 43.

Figure 3:
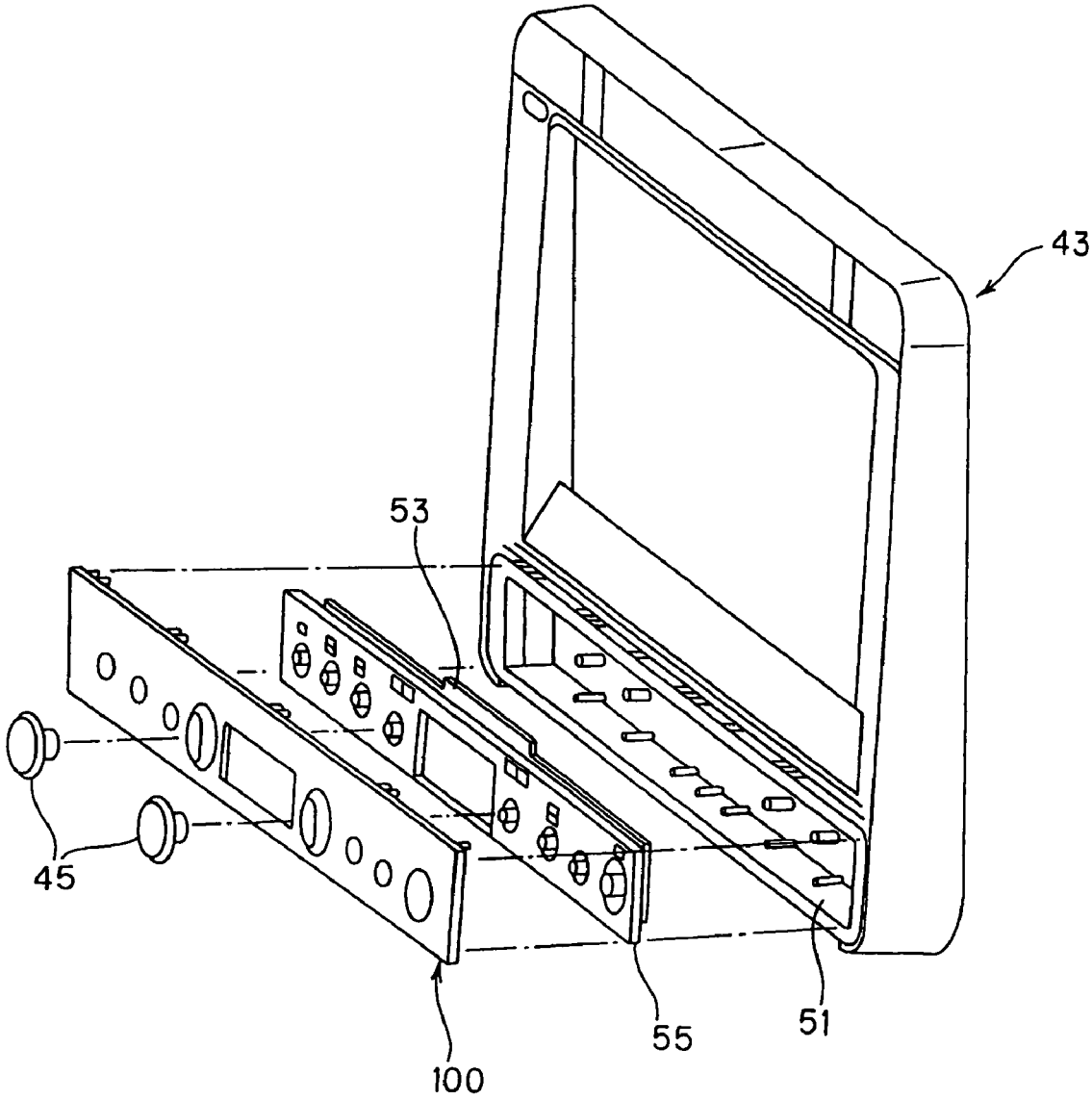
FIG. 3 is an exploded perspective view showing assembling the display panel to an open/close door.

FIG. 3 is an exploded perspective view illustrating assembling steps of the display panel to the open/close door.

In the lower portion of the open/close door 43, an operation and control unit receiving space 51 is formed. In the operation and control unit receiving space 51, the display panel 100 is fixed along with a rear face panel 55, to which a circuit board 53 is attached, being sandwiched therebetween. As shown in FIG. 1, the switch press member 25, the switch 27, the light sources 31 and 33, the partitioning walls 35 and the like are disposed on the rear face panel 55. By assembling the rear face panel 55 to the display panel 100, the control display panel having the input and display (notification) function is configured. Here, a configuration in which the control display panel is attached to the open/close door 43 has been described. However, the control display panel may be provided in a portion different from the open/close door 43.

Here, an example of configuration of a microwave oven 200 to which the display panel 100 according to the present invention is applied will be described in further detail.

Figure 4:
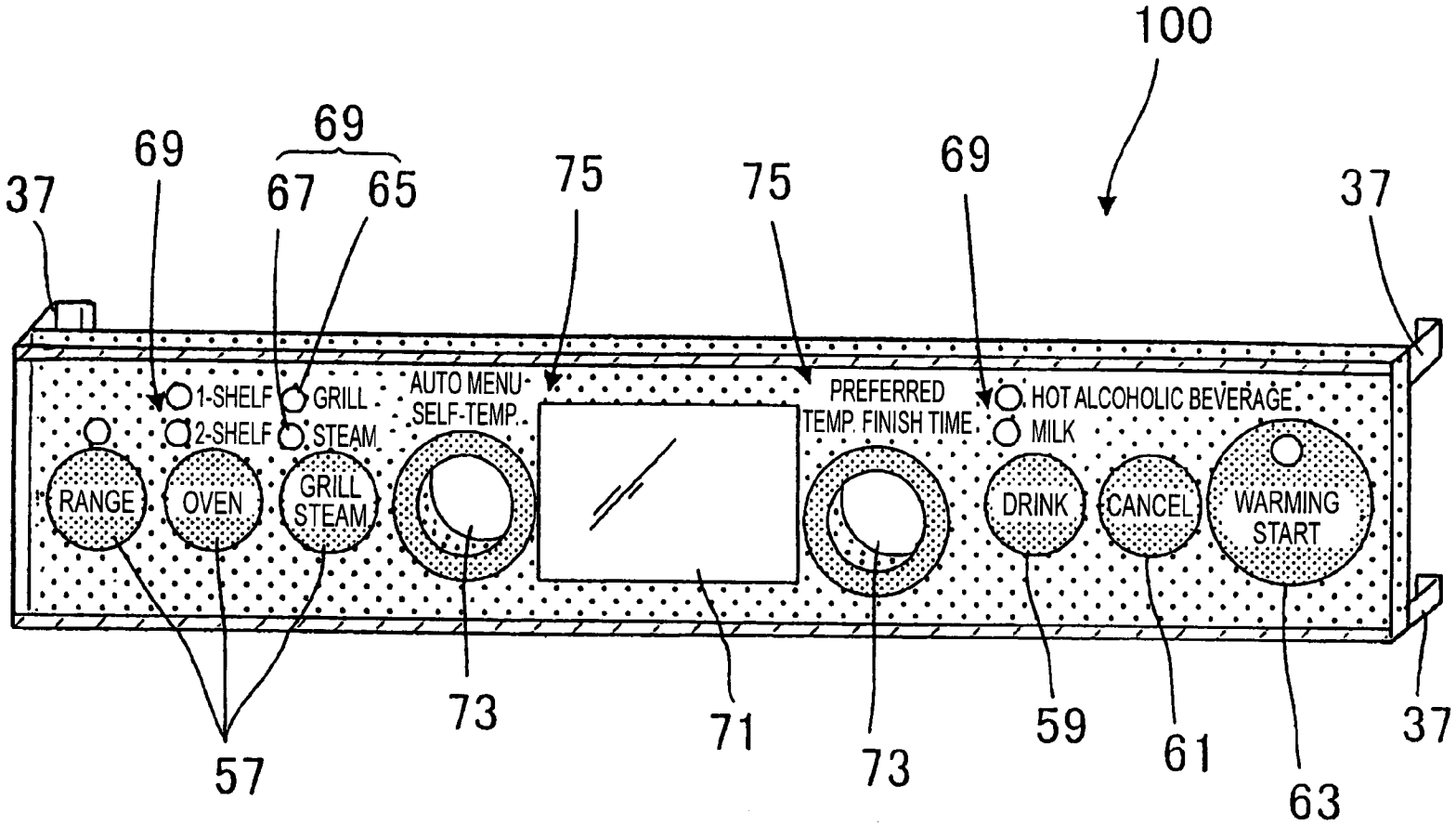
FIG. 4 is an external perspective view of the display panel.

FIG. 4 is an external perspective view of a display panel 100.

The display panel 100 has embossed portions 57, corresponding to heating mode selection keys such as "range," "oven," "grill/steam" shown as an example, an embossed portion 59 corresponding to an automatic heating key of a specific object to be heated for carrying out in accordance with a program in which a specific heating object (here, heating of a drink) is preset, an embossed portion 61 corresponding to a cancel key for canceling the operation, and an embossed portion 63 corresponding to a start key for instructing to start heating. Also, the display panel 100 has a plurality of selection display sections 69 such as a display area 65 with light, which is lit when grill heating is carried out, and a display area 67 with light, which is lit when steam heating is carried out, in which the selection display sections 69 as a notifying unit to notify the set content of heating is selectively turned ON.

Further, the display panel 100 has a transparent portion 71 for the display section 47 shown in FIG. 2, and is formed with openings 73 for attaching knobs 45. In the vicinity of mounting positions for the knobs 45, display areas 75 including character strings or the like, which are selectively lit corresponding to set heating mode, are disposed.

As shown in FIG. 1, the display panel 100 having the above-described appearance, includes an arrangement in which the front sheet 13 and the rear sheet 15, respectively having printed layers, are formed integrally with the panel base body 11.

Figure 5A:
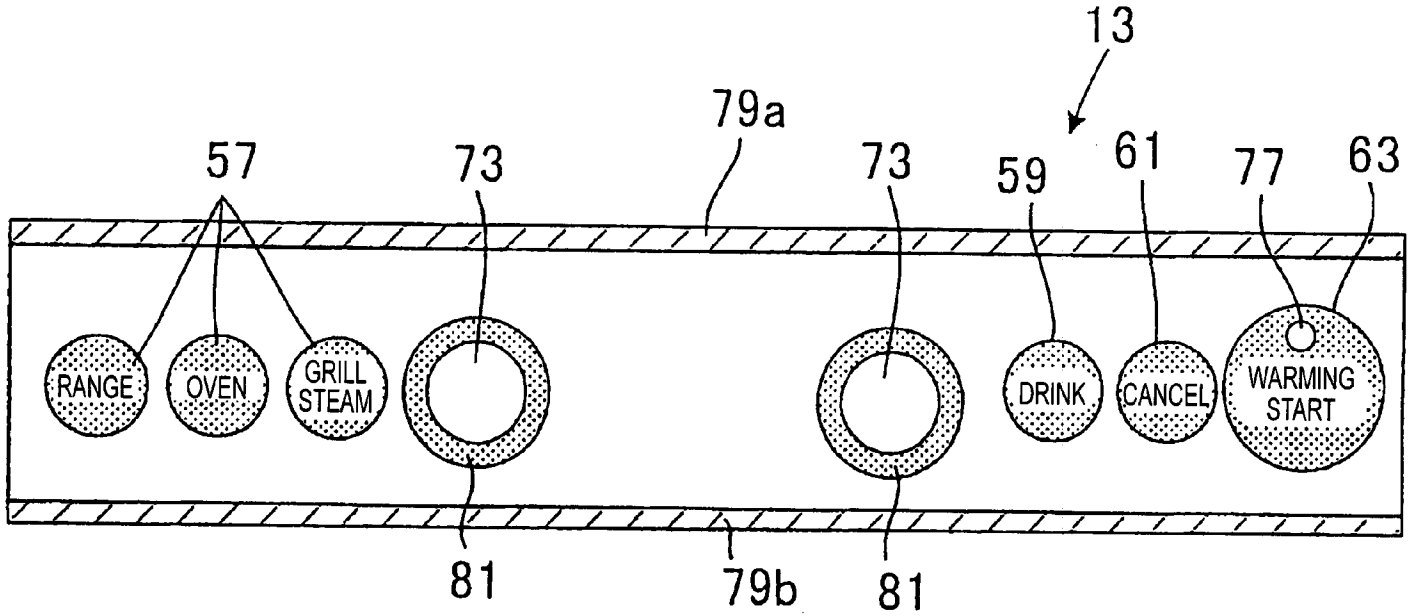
FIGS. 5A and 5B show a front sheet and a rear sheet used for the display panel shown in FIG. 4.
Figure 5B:
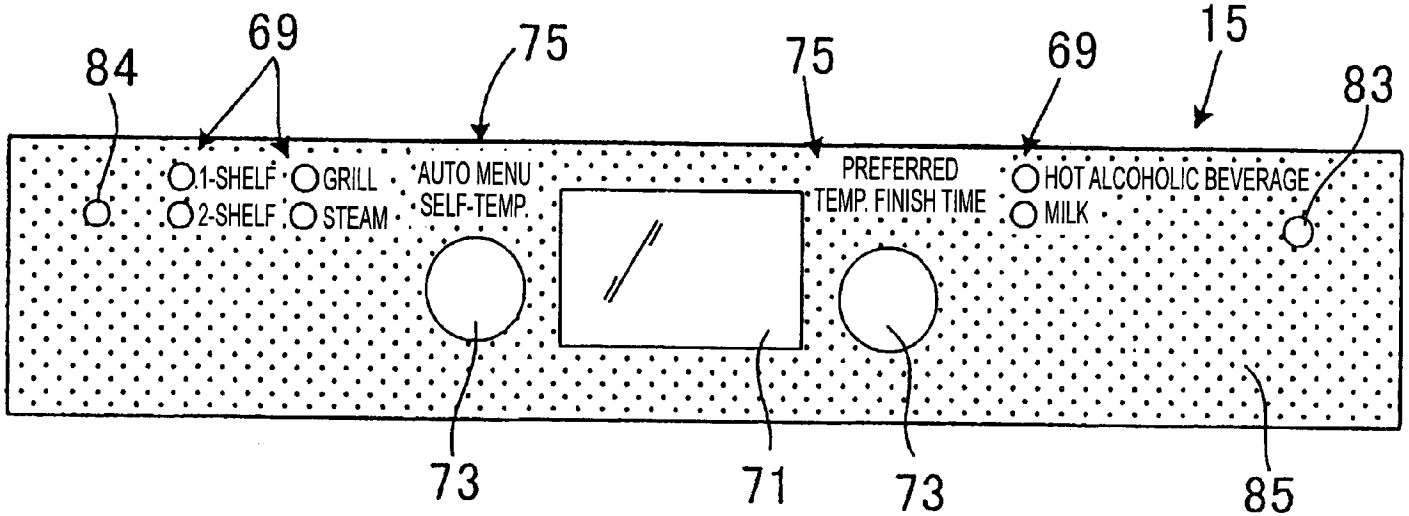

FIGS. 5A and 5B show the front sheet and the rear sheet which are used for the display panel shown in FIG. 4.

The front sheet 13 shown in FIG. 5A has embossed portions 57 corresponding to the heating mode selection keys, an embossed portion 59 corresponding to the automatic heating key, an embossed portion 61 corresponding to the cancel key and an embossed portion 63 corresponding to the start key; each of them are printed with characters indicating the content of the key and opaque base. A transparent portion 77 for a light indicator is formed on the embossed portion 63 corresponding to the start key. Strip-like medium printed areas 79*a* and 79*b* are formed along the upper and lower edge portions so as to include the positions opposite the edge portions disposed with engagement catches 37 of the display panel 100. Also, a printed area is formed on the periphery of the openings 73, respectively. The area excluding the above-mentioned printed areas in the front sheet 13 is transparent.

The rear sheet 15 is formed with the openings 73 the same as the front sheet 13. A part of the display area 75, lamp display sections 69 and areas 83 and 84 are subjected to a medium printing; the other character strings ("1-shelf," "2-shelf," "grill," "steam," "automatic menu" etc.) are printed in opaque. Further, irrespective of these displays, opaque pattern 85 for coloring the entirety of the panel is printed as a base for the entirety of the panel.

These front sheet 13 and the rear sheet 15 are integrally attached to the panel base body 11 having translucency. Thereby, the display having depth and a quality sense of translucency as shown in FIG. 4 is obtained. Also, the portion for operating the microwave oven is printed on the front sheet 13 side and contents and state of the settings are displayed on the rear sheet 15 side. Thereby, the visibility and the operational performance of the microwave oven are enhanced and the user-friendliness is also increased.

Next, the effect of illumination from the rear face side in the display panel 100 will be described in detail.

Figure 6:
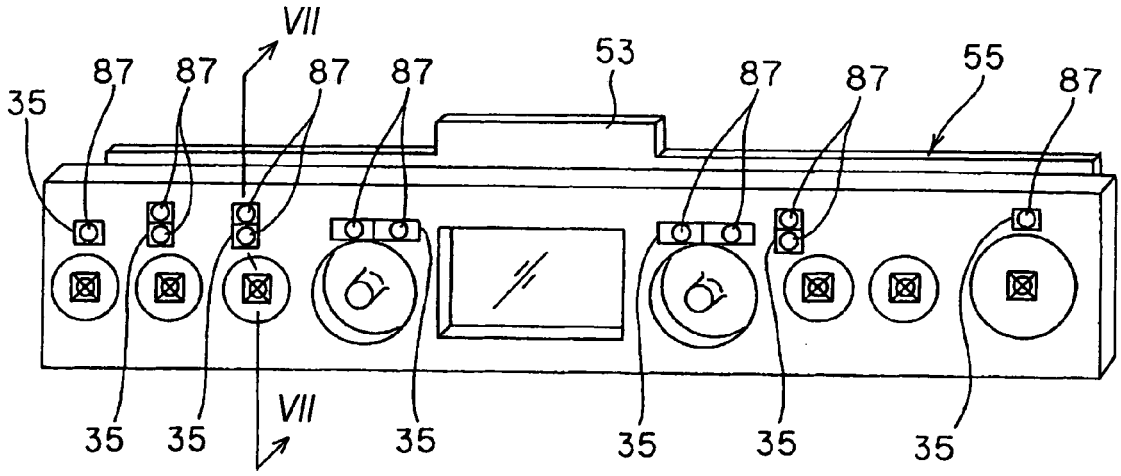
FIG. 6 is a perspective view of the rear face panel.
Figure 7:
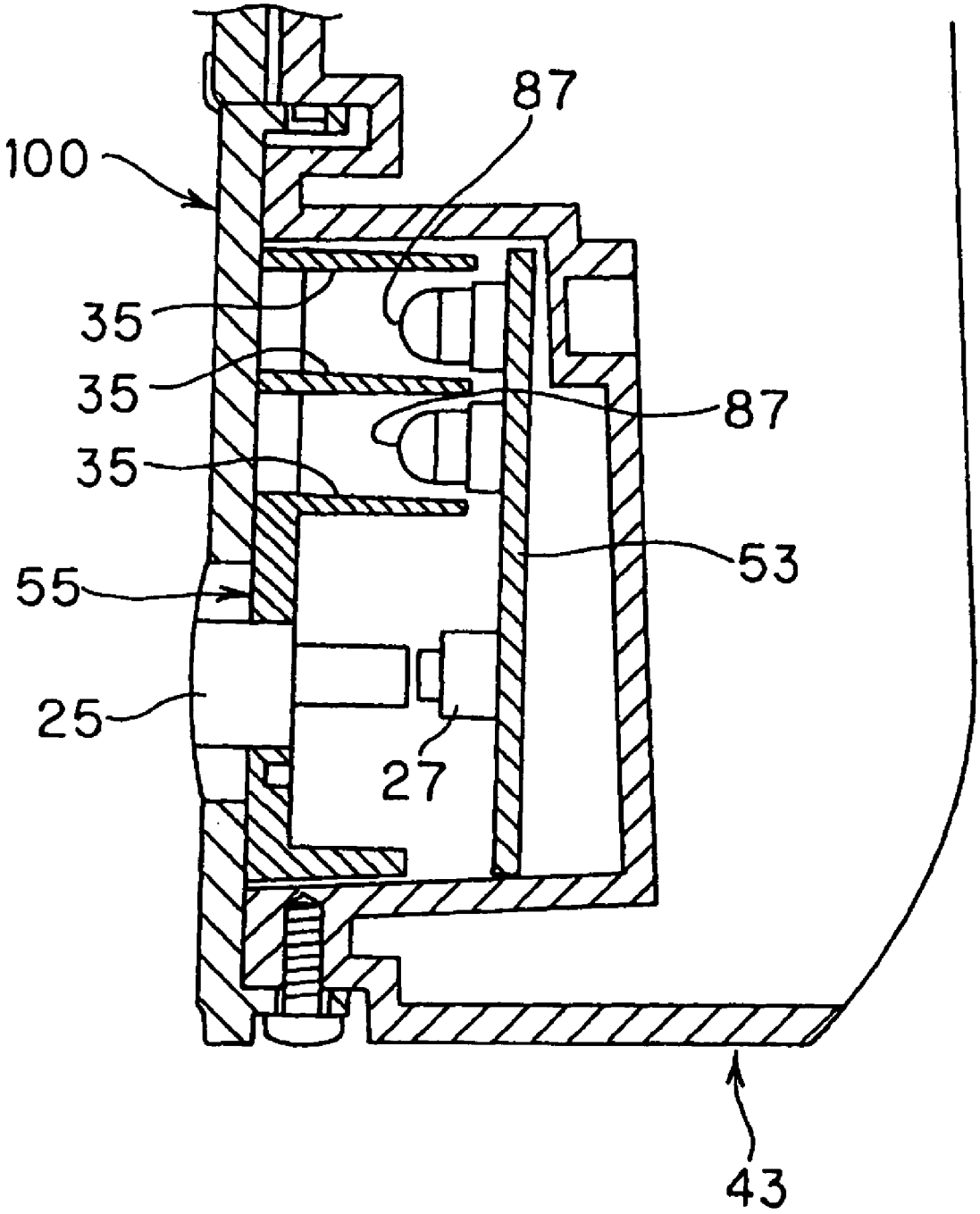
FIG. 7 is a sectional illustration of the display panel and the open/close door taken along the section VII-VII in FIG. 6.

FIG. 6 is a perspective view of the rear face panel. FIG. 7 is an illustration showing a section of the display panel and the open/close door taken along the line VII-VII in FIG. 6.

As shown in FIG. 6, in the circuit board 53 attached to the rear face panel 55, a plurality of LEDs 87, which are the light sources for display are disposed corresponding to the lamp display section 69, the display area 75 and the area 83 and 84 in the rear sheet 15. Further, partitioning walls 35 for covering the periphery of the respective LEDs 87 are formed. The relationship between each of the LEDs 87 and the partitioning walls 35 is shown in FIG. 7 in detail.

In the display panel 100, as described above, the light outputted from the light source is occasionally reflected by the boundary face of the panel base body 11 resulting in returned light. However, the returned light is not reflected again nor returned to the display side. Accordingly, even when the LEDs 87 and 87 are disposed close to each other, no leaked light is displayed.

Additionally, the LEDs 87 are positioned away from the display panel 100 and are partitioned from the surroundings by the partitioning walls 35. Thereby, the outside light is prevented from entering inside the partitioning walls 35. Thus, only the light having a direct advance component from the LEDs 87 toward the display panel 100 is selectively irradiated to the display panel 100. Owing to the above-described arrangement, the effects to prevent the light from leaking function in a multiplied manner resulting in a further high quality display.

Figure 8A:
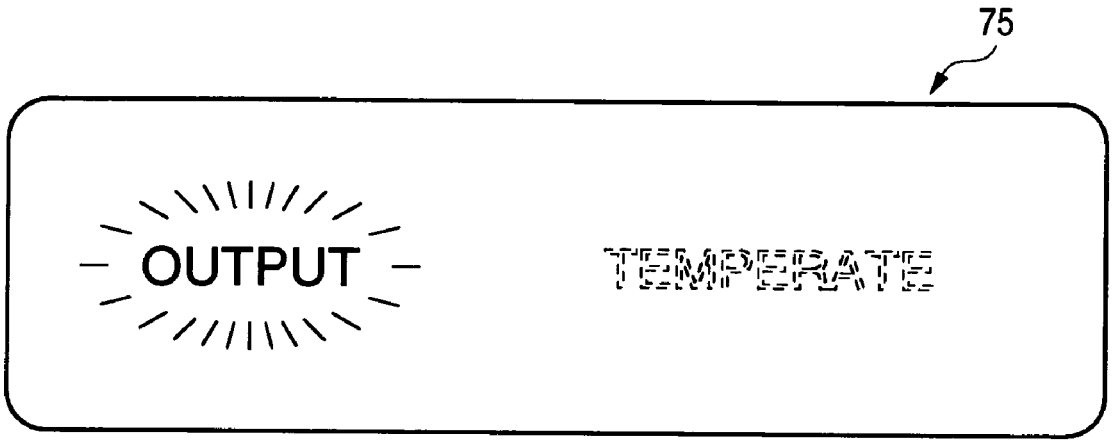
FIGS. 8A and 8B are illustrations showing a display area which is medium printed in the rear sheet and the display states of "output" and "temperature"
Figure 8B:
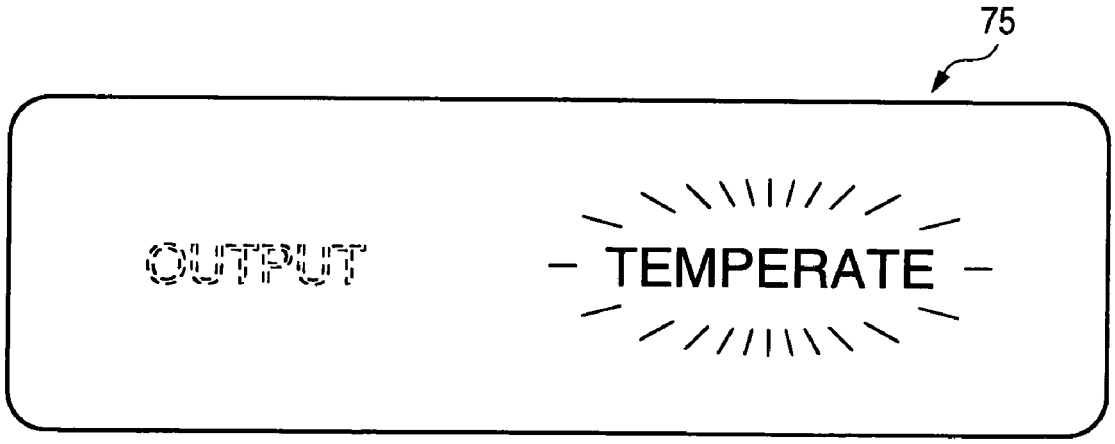
Figure 9A:
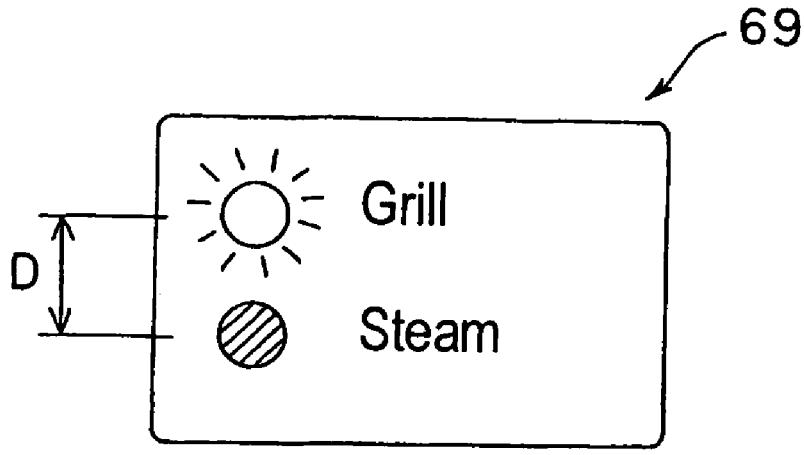
FIGS. 9A and 9B show states of display of a lamp display section.
Figure 9B:
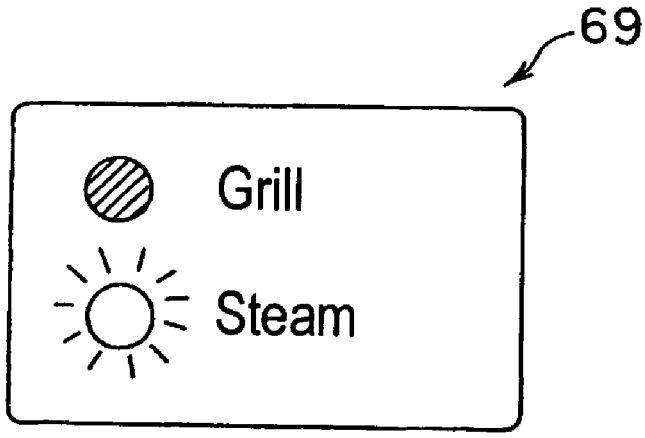

FIG. 8 and FIG. 9 show the states in which the illumination display is made while preventing the light from leaking.

FIG. 8 shows the display area 75 medium printed on the rear sheet 15, and the state ON/OFF of "output" and "temperature" are shown in FIG. 8A and FIG. 8B. As described above, by carrying out the medium printing on the character (outlined letter) portion such as "output" and "temperature," when the portion of characters is not illuminated, it appears as if no characters; thus a simple design is obtained. As a result, an easy-to-use display mode is obtained.

FIG. 8A shows a state in which, when the content to be displayed on the display section 47 (refer to FIG. 2) is the output value, only the characters of "output" are lit. FIG. 8B shows a state in which, when the content to be displayed on the display section 47 (refer to FIG. 2) is the temperature, only the characters of "temperature" are lit. As described above, by illuminating the characters themselves such as "output" and "temperature," the content displayed on the display section 47 can be clearly notified to a user without misunderstanding.

In the notifying method in which the characters themselves are illuminated as described above, in a state there the entirety of the characters to be displayed can be seen and no unnecessary luminescent display is found in the surroundings, the user can recognize the displayed content. Therefore, the characters to be displayed are required to be illuminated at uniform brightness; and the characters close thereto, which should not be displayed, are required to be reliably prevented from being illuminated. However, due to the trend toward miniaturization in electronic apparatuses such as microwave ovens, the area available for displaying on the display panel is limited and the density of the display is increasing. Further, accompanying the trend toward higher performance of apparatuses, the amount of contents to be displayed is also increasing. As a result, characters to be distinguished from each other are required to be displayed extremely close to each other. Therefore, in an ordinary preventive manner against light leakage in which a partitioning wall 35 is formed around the light source, a problem such that the neighboring characters are illuminated is generated.

The above-described situation is the same in the lamp display section shown in FIG. 9. The disposition distance D of the LEDs has to be arranged smaller, and the light at the side to be ON has to be prevented from leaking to the side to be OFF. However, in ordinary preventive measures against light leakage, the light is hardly prevented from leaking in a reliable manner.

However, in the display panel according to the present invention, since a configuration to reliably prevent the returned light from the light source from being reflected to the display side is adopted, light leakage does not occur. Accordingly, by employing the display panel 100, a partitioning wall 35, which is designed as ordinary preventive measures against light leakage, ensures a stable high quality display free from light leakage without requiring a particular design change.

Next, an example of the molding method of the display panel 100 will be briefly described.

FIG. 10 shows the molding sequence of the display panel.

Figures 10A, 10B, 10C:
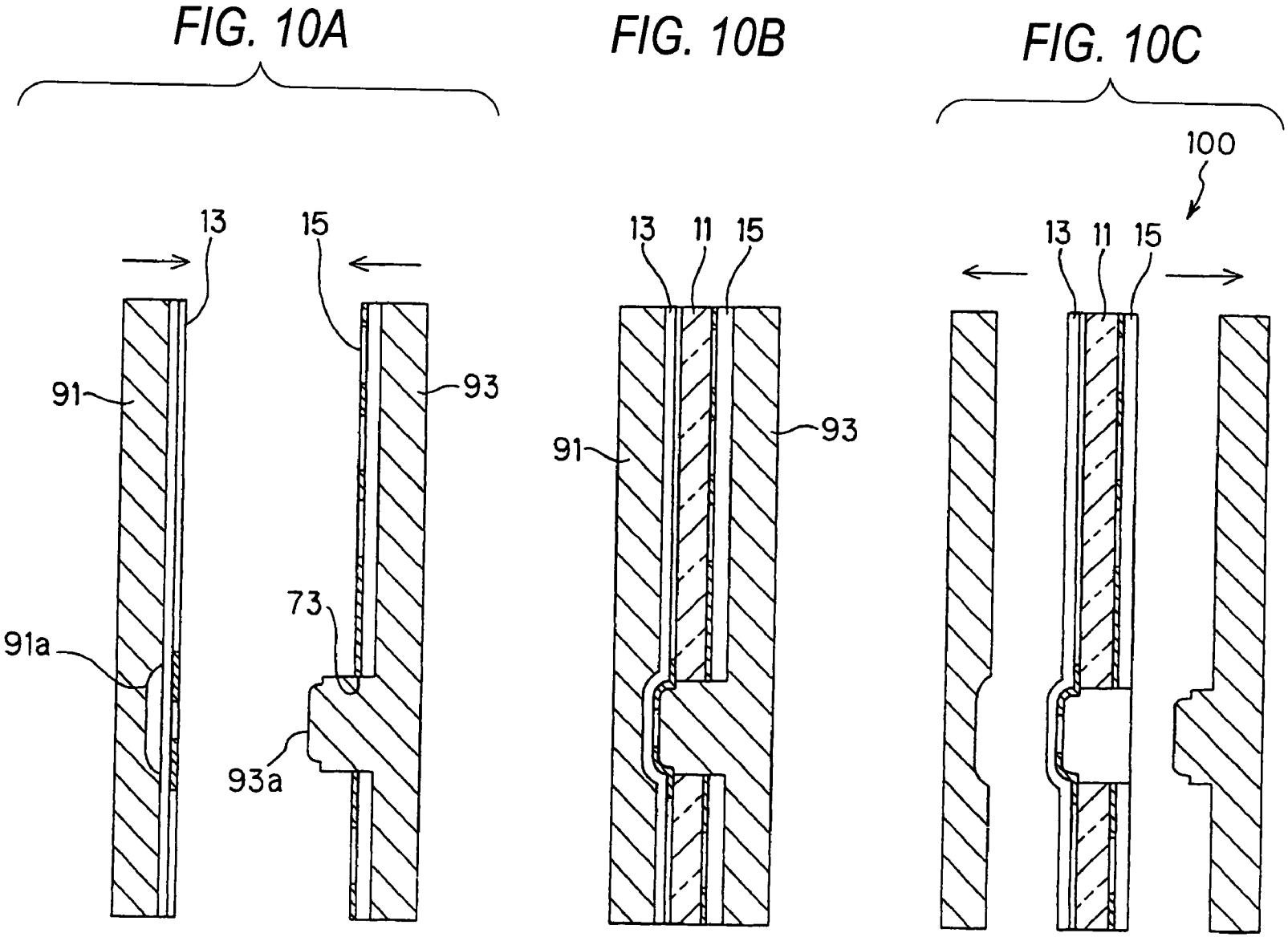
FIG. 10 shows the molding procedure of the display panel.

The display panel 100 is pressed and molded in the dies of an injection-molding machine. First, as shown in FIG. 10A, the front sheet 13 is placed on one die 91; and the rear sheet 15 is placed on the other die 93. The die 91 is formed with a concave portion 91*a* for forming the embossed portion; the die 93 is formed with a convex portion 93*a* at the position corresponding to the concave portion 91*a*. The rear sheet 15 is placed on the die 93 being inserted by the convex portion 93*a* through the opening 73.

Then, as shown in FIG. 10B, the dies 91 and 93 are closed and the die temperature is controlled to a predetermined temperature. A molding material such as transparent resin material is injected into the dies and maintained under a pressure. Here, the molding material is injected between the front sheet 13 and the rear sheet 15 placed in the cavity of the dies. Since the convex portion 93*a* of the die 93 presses the front sheet 13 against the concave portion 91*a* of the die 91, the front sheet 13 is deformed along the concave portion 91*a* and subjected to an embossment processing. Then, as shown in FIG. 10C, after cooling down for a predetermined period of time, the dies are opened, and a molded article (display panel 100) is taken out. In this manner, the front sheet 13 and the rear sheet 15 are integrated with the panel base body 11 which is molding material sandwiched therebetween, and the embossed portion is formed in a part of the front sheet 13.

Next, a detailed description will be made about the display panel 100 in order.

Figure 11:
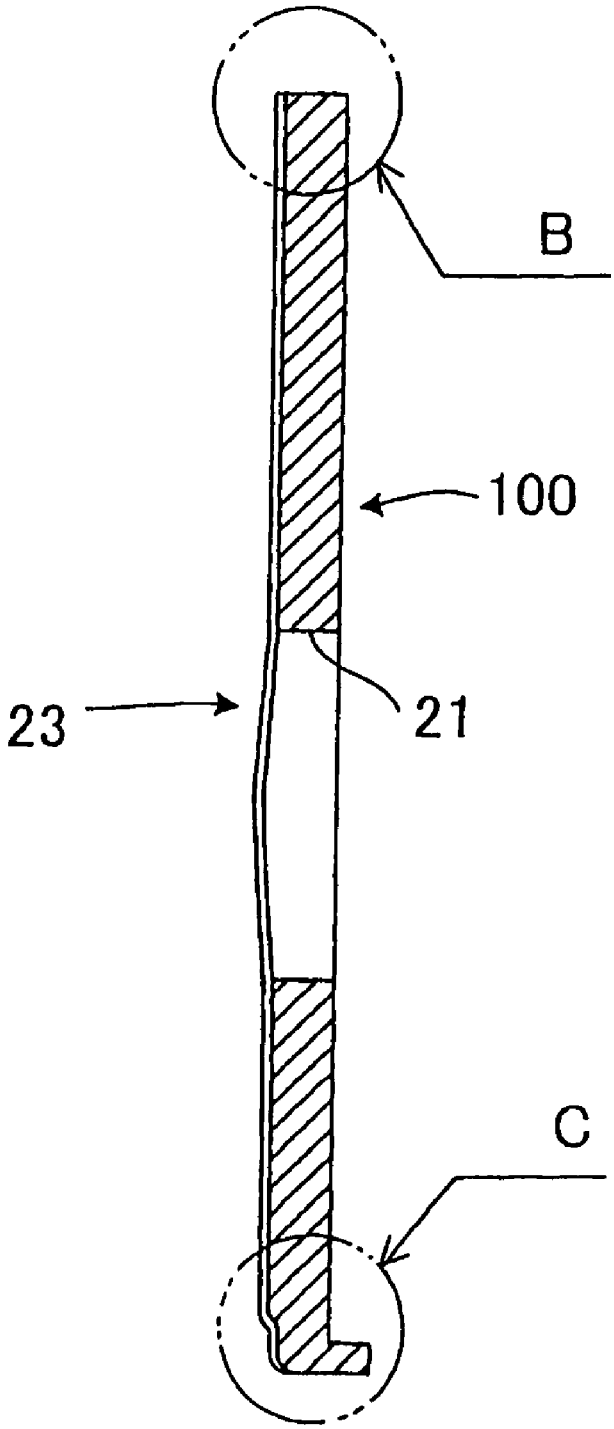
FIG. 11 is a sectional view of the display panel.
Figure 12A:
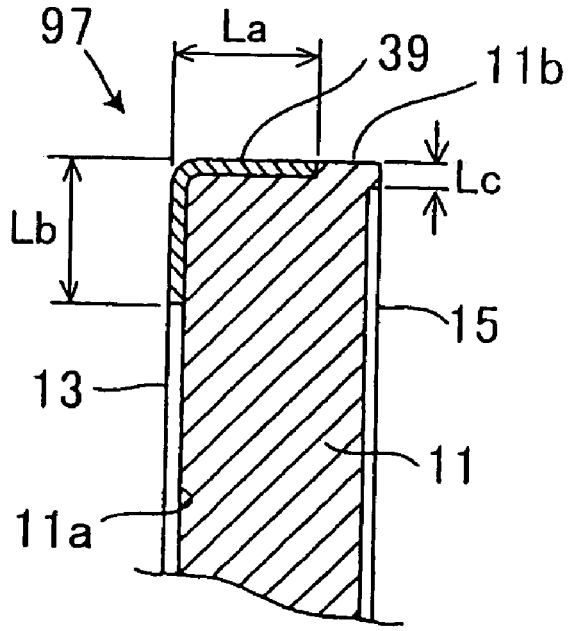
FIGS. 12A and 12B are arrangements of the end portion of the front sheet and the rear sheet which are enlarged sections of a part B shown in FIG. 11.
Figure 12B:
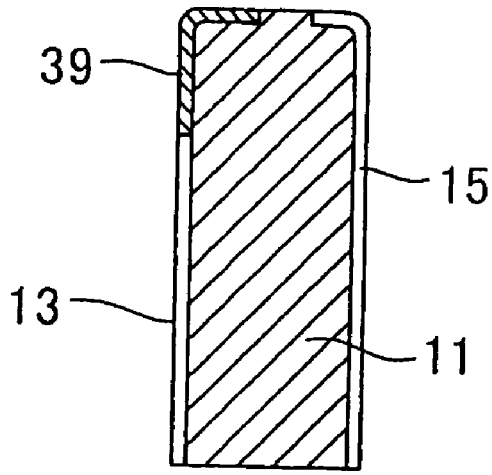
Figure 13:
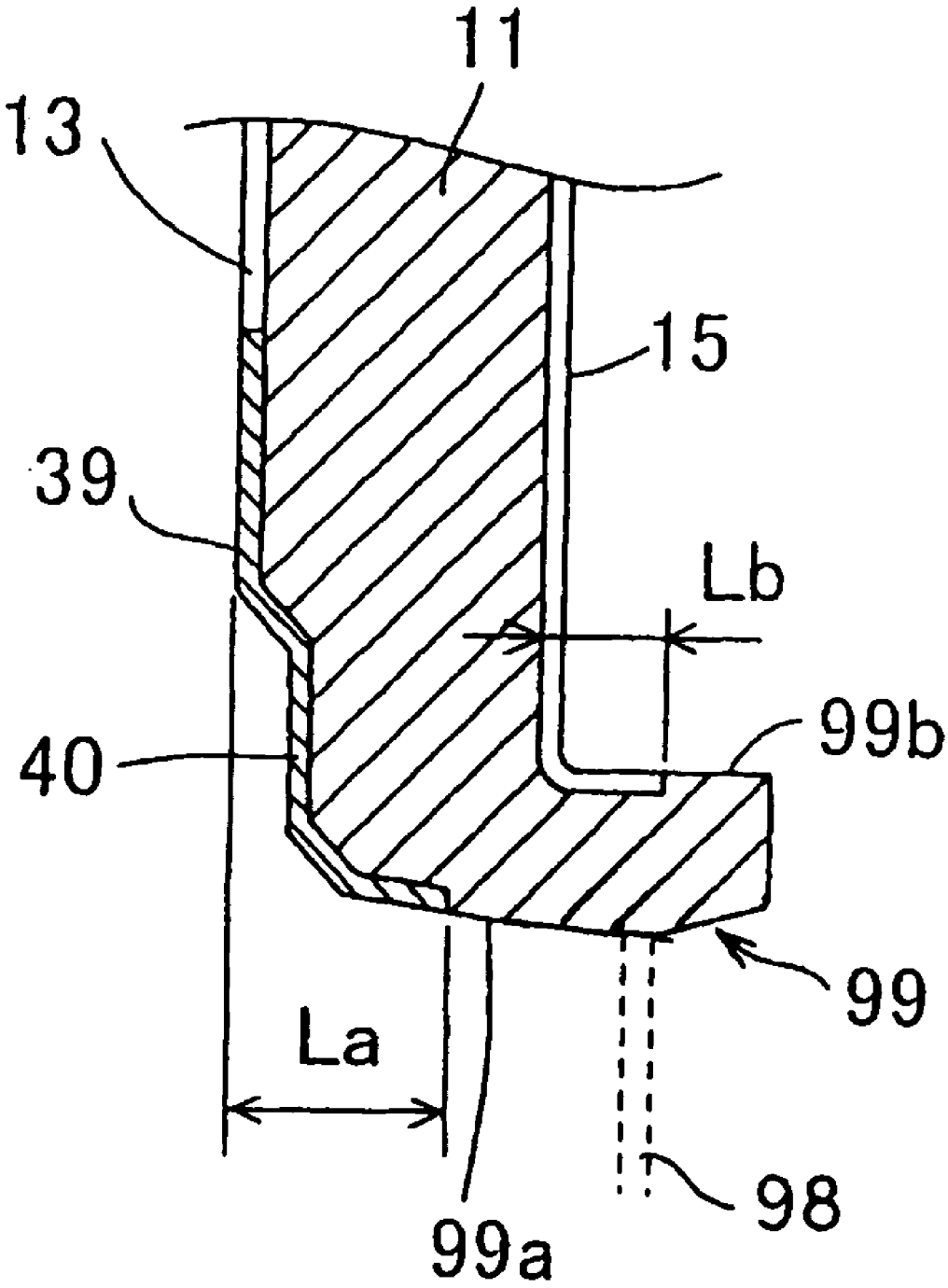
FIG. 13 is an enlarged sectional view of a portion C shown in FIG. 11.

FIG. 11 is a sectional view of the display panel. FIGS. 12A and 12B shows examples of arrangements of the end portion of the front sheet and the rear sheet respectively, in enlarged sections of the part B shown in FIG. 11. FIG. 13 is an enlarged sectional view of the portion B shown in FIG. 11.

In FIG. 12A showing an example of the portion B in FIG. 11, the end portion of the front sheet 13 is extended from the front side surface 11*a* of the panel base body 11 to the side end surface 11*b* to form a bended portion 97.

The end portion of the rear sheet 15 is disposed at a portion inner than the side end surface 11*b* of the panel base body 11. The reason for this is as described below; i.e., in the insert molding process, precise alignment between the sheet end portion and the resin end portion is difficult, and when the sheet sticks out of the resin end portion, the molded article is disposed of, or the sheet is cut off. Further, in the case where the rear sheet is disposed in an inner portion of the resin end portion, when viewed from the front side of the display panel 100, the joint portion between the rear sheet 15 and the resin portion becomes visible resulting in a problem in appearance if the joint portion is left as it is. Therefore, by forming the medium printed area 39 at the end portion of the front sheet 13 to conceal the joint portion, the problem in appearance is eliminated. As for the alignment between the sheet end portion and the resin end portion of the front sheet 13, according to this configuration, the problem of displacement is eliminated by forming the bended portion 97 in the same manner as the above.

In the bended portion 97, the turn in length La from the end portion of the front sheet 13 is at least 2 mm or more for leaving a margin for displacement. And further, a medium printed area 39, in which the length Lb from the side end surface 11*b* of the panel base body 11 is 2 mm or more, is formed. As for the end portion of the rear sheet 15, the length Lc from the side end surface 11*b* of the panel base body 11 is preferably set to 0.3 mm or less.

When the panel base body 11 has an enough space in thickness, it may be arranged so that the rear sheet 15 is turned in as shown in FIG. 12B.

In the portion C shown in FIG. 13, in the end portion of the panel base body 11, a rib 99 is formed. In order to prevent the rib 99 from being viewed from the front side, the front sheet 13 has the medium printed area 39 and the opaque printed area 40. The end portion of the front sheet 13 is turned in to the inner side surface 99*a* of the rib 99 by a length of La. On the other hand, the end portion of the rear sheet 15 is turned in to the inner side surface 99*b* of the rib 99 by a length of Ld The length Ld is preferably set to 1 mm or more for ensuring the margin for alignment of the sheet.

Further, on the outer side surface 99*a* of the rib 99, a gate 98 for injecting the transparent resin material for the panel base body 11 is formed. A flaw or the like made by cutting off the gate 98 after molding is concealed by the medium printed area 39 and the opaque printed area 40.

Next, a configuration, in which the front sheet and the rear sheet are formed on the convex portion and the through hole formed in a portion of the front surface of the display panel 100, will be described.

Figure 14:
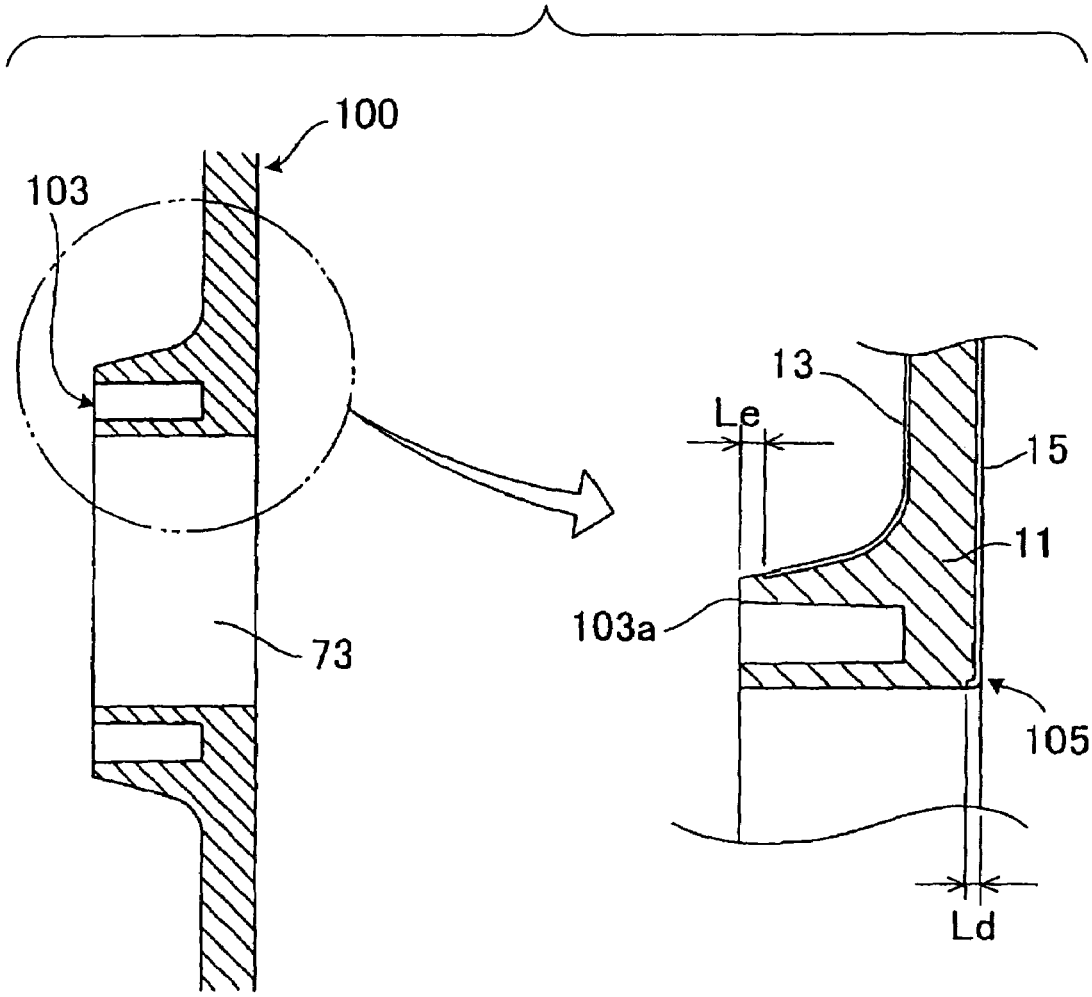
FIG. 14 illustrates a section of mounting position for a knob in the display panel.

FIG. 14 illustrates a mounting section for a knob on the display panel.

The panel base body 11 of the display panel 100 has an opening 73 through which a shaft for attaching the knob (refer to FIG. 2 and FIG. 3) is inserted. In the periphery of the through hole, a convex portion 103 projecting toward the display side is formed. The front sheet 13 is extended along the external periphery surface of the convex portion 103, and the end thereof is positioned at a length of Le from the front-end surface 103*a* of the convex portion 103. The length Le is set to 1 mm or less. The rear sheet 15 is turned in to the edge portion of the opening 73 by a length of Ld. The length Ld is set to 0.5 mm or more. As described above, the end portion of the front sheet 13 is positioned at a point in front of the front-end surface 103*a* of the convex portion 103, and the bended portion 105 is formed in the rear sheet 15. Thereby, the end portion of each sheet is well arranged, and the manufacturing process is also simplified.

Next, a configuration, in which the rear sheet is formed on the convex portion formed in a part of the front surface of the display panel 100, will be described.

Figure 15:
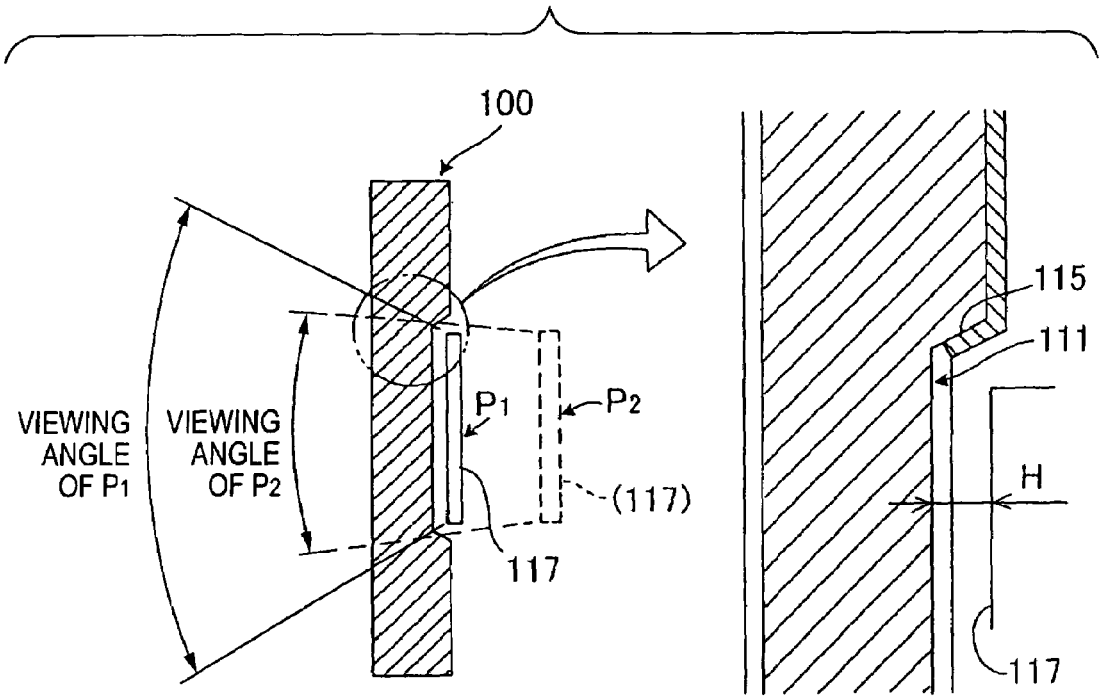
FIG. 15 is a sectional view schematically showing a concave portion formed in the display panel.

FIG. 15 is a schematic sectional view of a concave portion formed on the display panel.

In the panel base body 11 of the display panel 100, a concave portion 111 is formed at a position opposed to the display section 47 (refer to FIG. 2). The rear sheet 15 is formed along the front surface of the concave portion 111 in a convex-shape in the area corresponding to the concave portion 111. The area of the rear sheet 15 facing the concave portion 111 is transparent. Accordingly, the rear sheet 15 is deformed into a convex-shape before-hand in a position facing the display section 47, and in this convex-shaped portion, a double-faced insertion molding is carried out.

In this configuration, since the concave portion 111 is formed at the position facing the display device 117 the distance between the display device 117 and the display panel 100 can be reduced as indicated with P1 in FIG. 15. As a result, the transparency of the display light is increased, and the visual angle is also widened.

Conventionally, the display panel 100 is formed of a sheet with flexibility of approximately 0.2 to 0.3 mm. In this case, in order to prevent, when the display section is depressed by a finger, the display device from coming into contact therewith, the display panel 100 and the display device of the display section are disposed by leaving a predetermined distance therebetween as indicated by a dotted line P2 in FIG. 15. As a result, the display area and the visual angle of the display unit are limited. However, owing to the arrangement of the present invention, the above limitation can be largely alleviated. As for the concave portion 111, by setting the recessed amount H from the front surface of the panel base body 11 to approximately 1 mm, the depth necessary for turn in processing of the rear sheet 14 is ensured.

Next, the arrangement of the end portion of the display panel 100 will be described.

Figure 16:
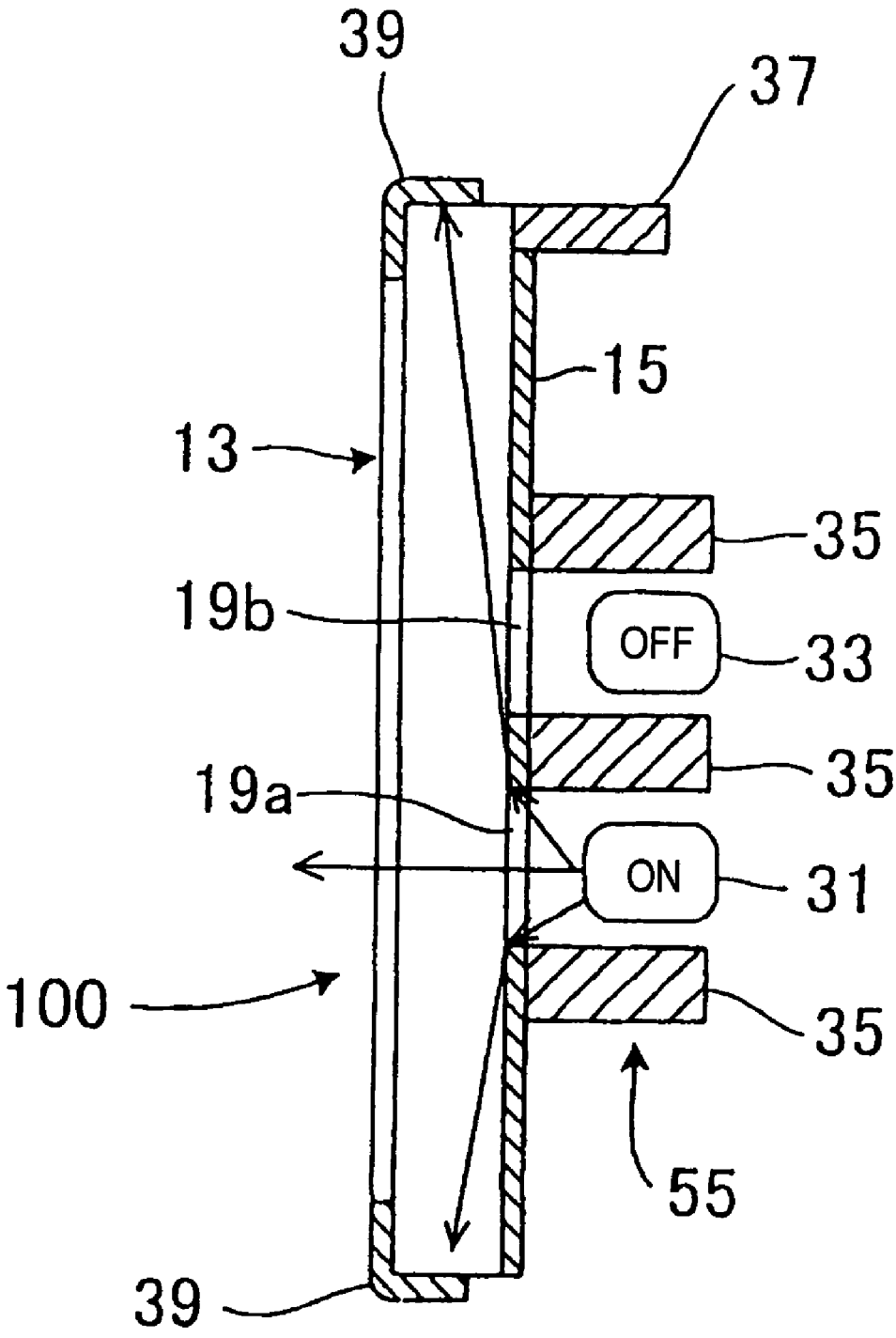
FIG. 16 is a partial sectional view schematically showing the rear face panel equipped with the display panel and the light sources.

FIG. 16 is a partial sectional view schematically showing the rear face panel having the display panel and the light source.

The rear face panel 55 including the light sources 31 and 33 and the partitioning wall 35 is attached to the rear side of the display panel 100 opposite side to the display side. The light from the light source 31 in the ON state is irradiated to the printed layer 19*a* of the front sheet 13. Here, the irradiation light is transmitted through the display panel 100 toward the display side, and a part thereof is transmitted toward the side end surfaces of the panel base body 11 due to the reflection or the like at the boundary face. In this case, a so-called a light edge phenomenon in which the end portion of the display panel 100 is lit is generated. Therefore, in the configuration of the present invention, the side end surface of the display panel 100 is formed with the medium printed area 39, thereby the above-mentioned light edge is concealed. Here, the medium printed area 39 is employed. However, the invention is not limited to the above. Solid printing may be employed. In FIG. 16, the upper and the lower side end surface on the display panel 100 is shown. However, if necessary, the printed area may be preferably formed around the entire periphery of the display panel 100. Owing to this, the light edge can be perfectly concealed. Accordingly, the problem in appearance can be reliably prevented.

Next, a modification having a configuration, in which the engagement unit of the display panel is not equipped with the catches, will be described.

Figure 17:
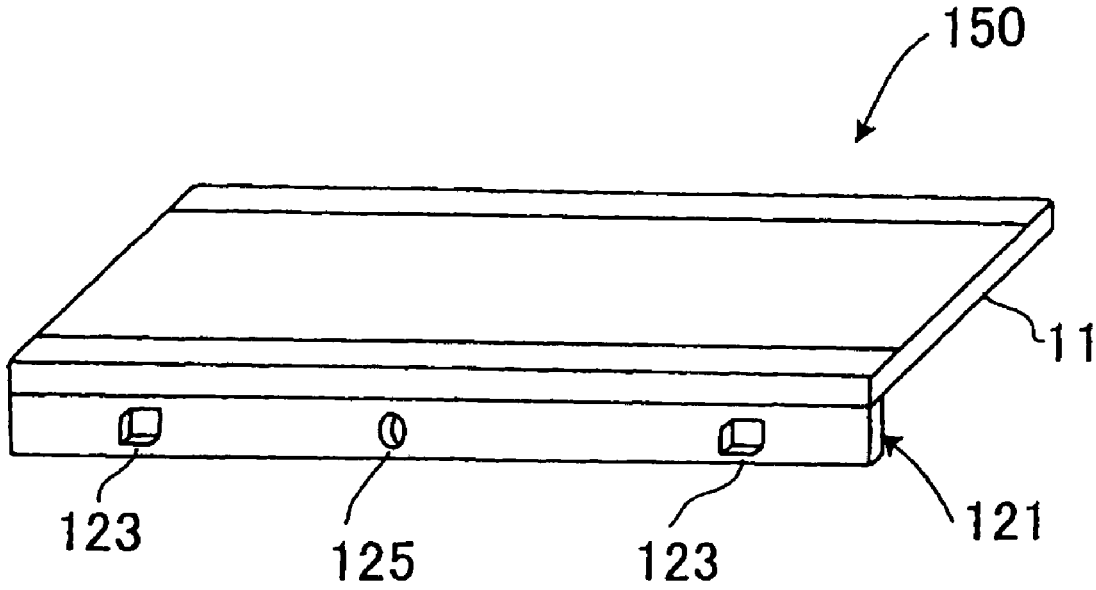
FIG. 17 is an external perspective view of a display panel showing a modification of a display panel.

FIG. 17 is an external perspective view of a display panel according to this modification.

A rib 121 is formed in the side end portion of the panel base body 11 of the display panel 150. Through holes 123 are formed in this rib 121. The display panel 150 is arranged so that the display panel 150 itself has no engagement catches, but the object to be attached is formed with engagement catches; and thus, the engagement catches are engaged with the through holes 123 in the display panel 150. Further, if necessary, a through hole 125 for fixing with a screw may be formed to increase the connection strength with the object to be attached.

According to the configuration of the display panel 150, in place of the engagement catches formed in plural faces, only the simple ribs 121 and through holes 123 are formed. Accordingly the structure and the manufacturing process are simplified.

Furthermore, the display panel may have the following configuration.

Figure 18:
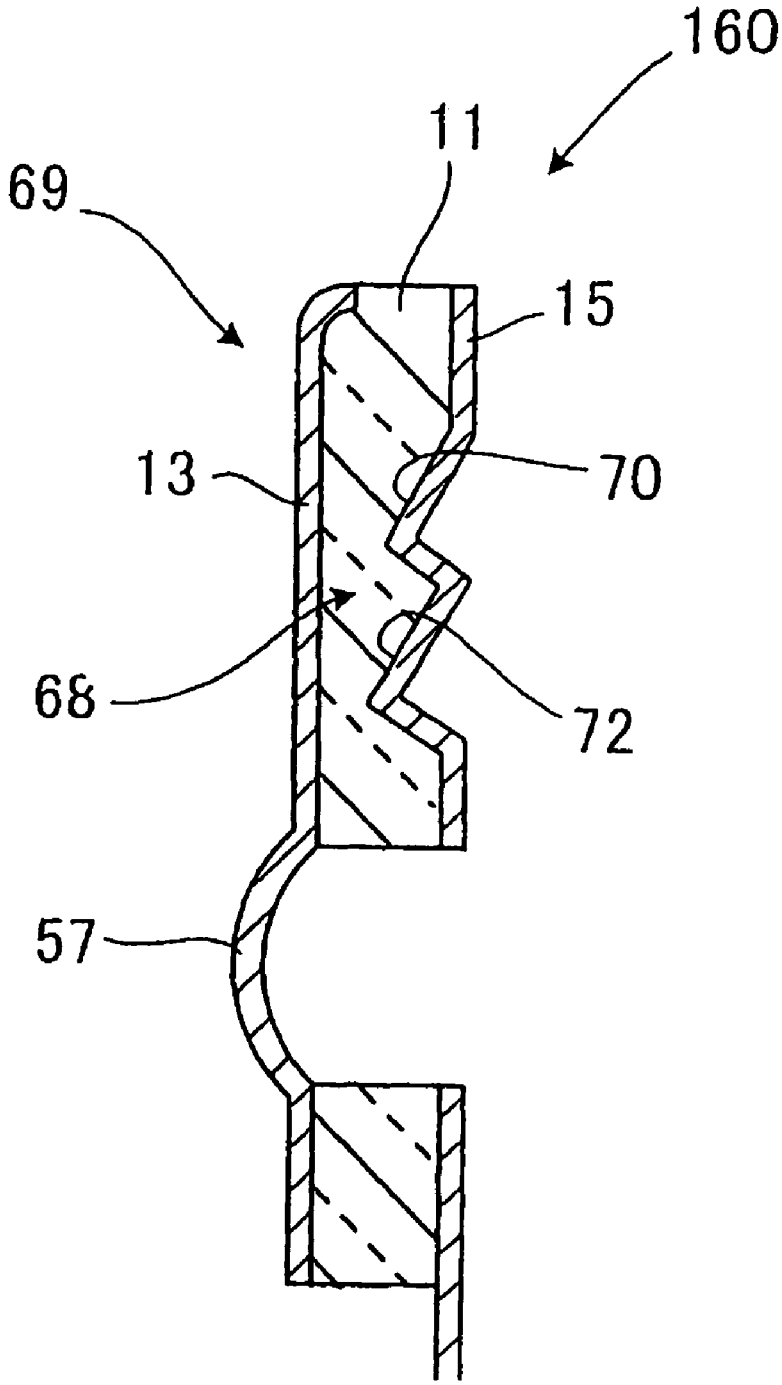
FIG. 18 is a sectional view of the display panel showing another modification of the display panel.

FIG. 18 is a sectional view of a display panel.

The display panel 160 of this configuration is formed with a stepped portion 68 in a portion in which the lamp display section 69 of the rear side of the panel base body 11 is disposed. That is, the characters of "grill," "steam" and the like are disposed on the rear sheet 15 so that these characters are disposed on the sloped surfaces 70 and 72 of the stepped portion 68 of the panel base body 11.

The direction of the normal line of the sloped surfaces 70 and 72 are oriented to the user of the display panel 160. Owing to this, the characters disposed on the sloped surfaces 70 and 72 are readily recognized visually. Beautiful appearance and high quality sense of the display panel 160 is obtained.

Hereinafter, a plurality of examples of preferred embodiments according to an insert molding method of the present invention will be described in detail with reference to the drawings.

Figure 19:
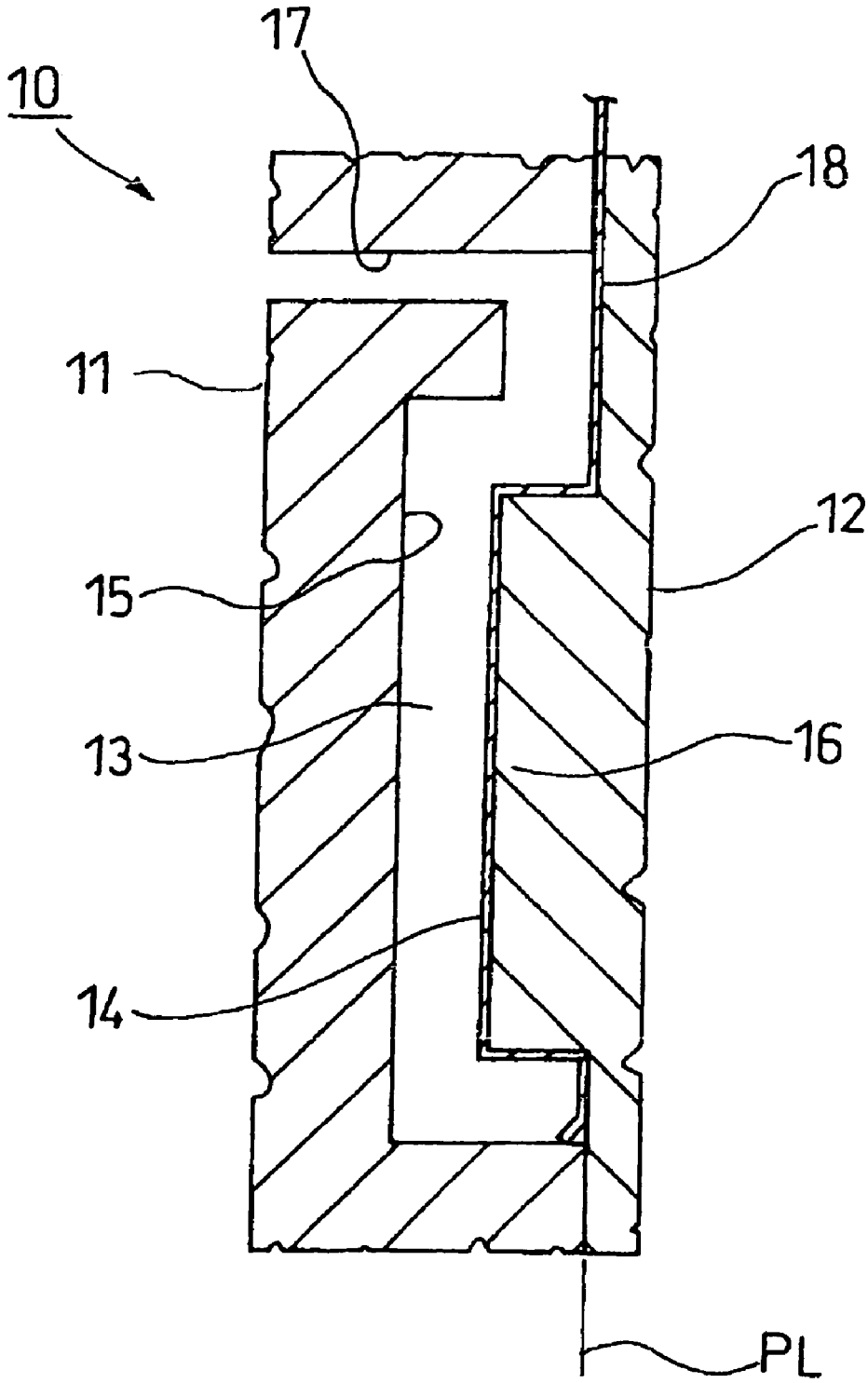
FIG. 19 is a sectional view illustrating an insert molding method of a second embodiment according to the present invention.
Figure 21:
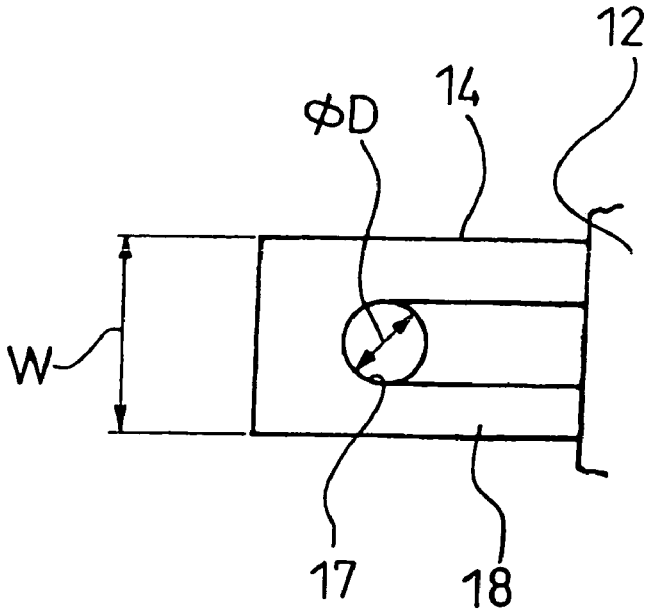
FIG. 21 is a schematic view of a gate and periphery thereof in the insert molding method shown in FIG. 19.
Figure 22:
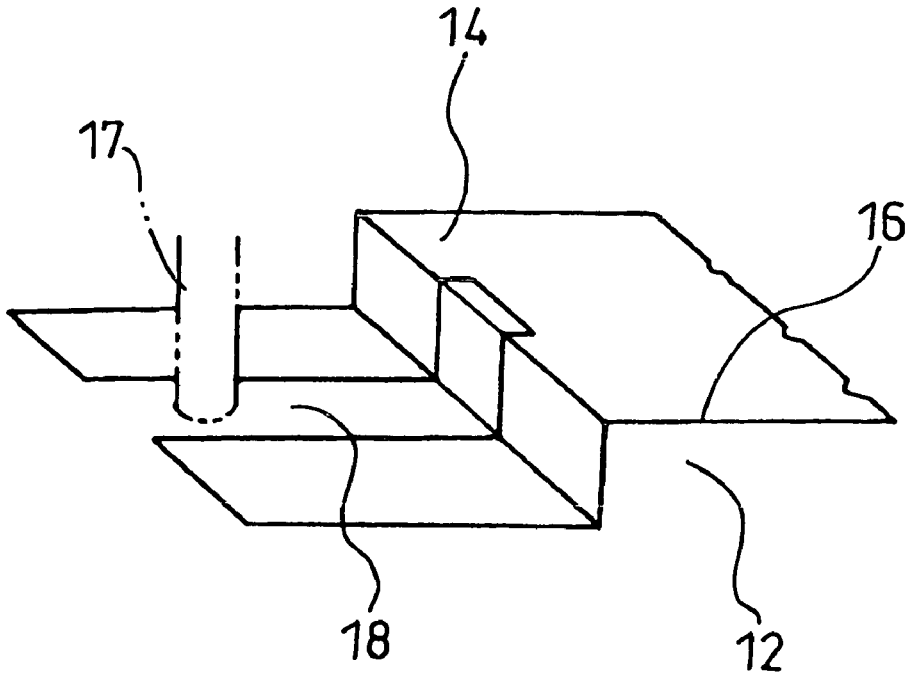
FIG. 22 is an external view of the gate and periphery thereof for the first half of the molding in the insert molding method shown in FIG. 19.
Figure 23:
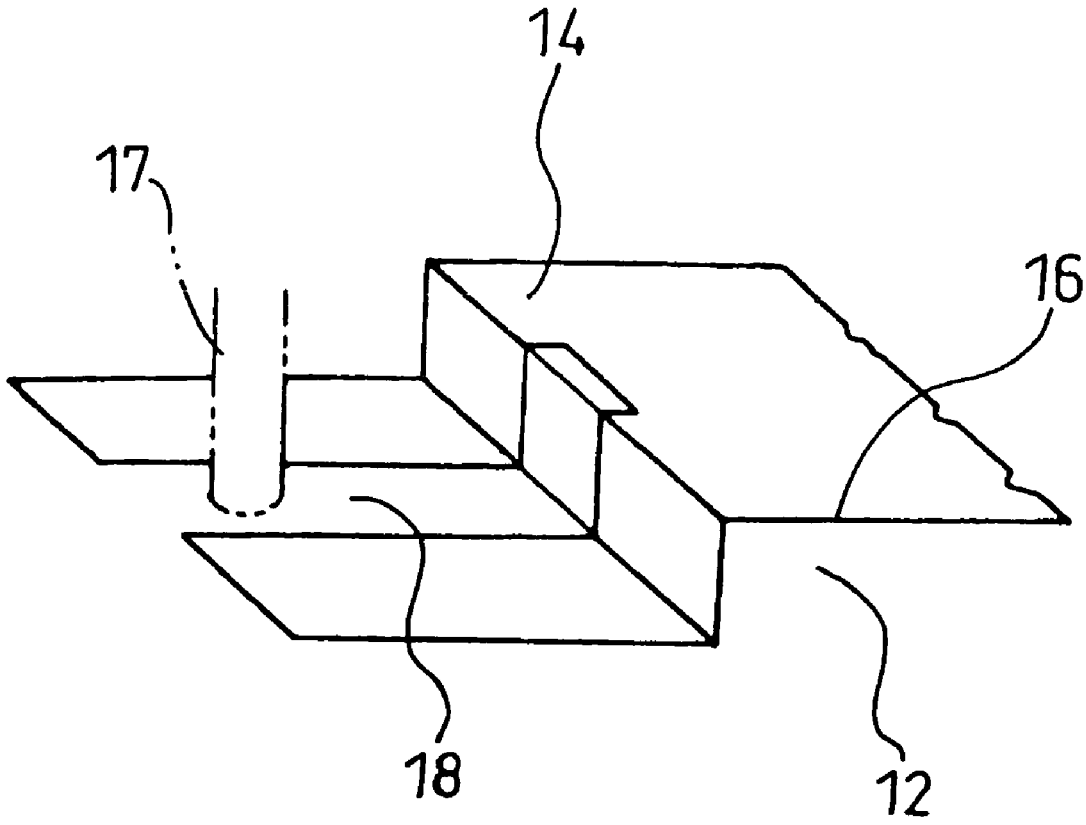
FIG. 23 is an external view of the gate and periphery thereof for the second half of the molding in the insert molding method shown in FIG. 19.

FIG. 19 is a sectional view illustrating an insert molding method of a second embodiment according to a present invention. FIGS. 20A to 20E illustrate a molding procedure for the insert molding method shown in FIG. 19. FIG. 21 is a schematic view of a gate and the periphery thereof in the insert molding method shown in FIG. 19. FIG. 22 is an external view of the gate and the periphery thereof for the first half of the insert molding method shown in FIG. 19. FIG. 23 is an external view of the gate and the periphery thereof for the second half of the insert molding method shown in FIG. 19.

As shown in FIG. 19, the insert molding method as the second embodiment of the present invention uses a molding machine 10 including an upper die 11 and a lower die 12. A sheet 14 is disposed on the lower die 12 side in a cavity 13 formed by the upper die 11 and the lower die 12.

A concave portion 15 is formed in the upper die 11, and a convex portion 16 disposed so as to face to the concave portion 15 is formed in the lower die 12. A gate 17 for filling a resin material is formed between the end portion of the upper die 11 and the end portion of the lower die 12. The upper die 11 and the lower die 12 are divided at a parting line PL.

The sheet 14 is a thin plate member made of macromolecule material having a heat resistance of 160 to 180° C. An extended portion 18 extended toward the end portion of the lower die 12 is formed at the base end side. The gate 17 is disposed above the extended portion 18 of the sheet 14.

Next, referring to FIG. 20A to FIG. 20E, the molding step of the insertion molding by the molding machine 10 will be described.

Figures 20A, 20B, 20C, 20D, 20E:
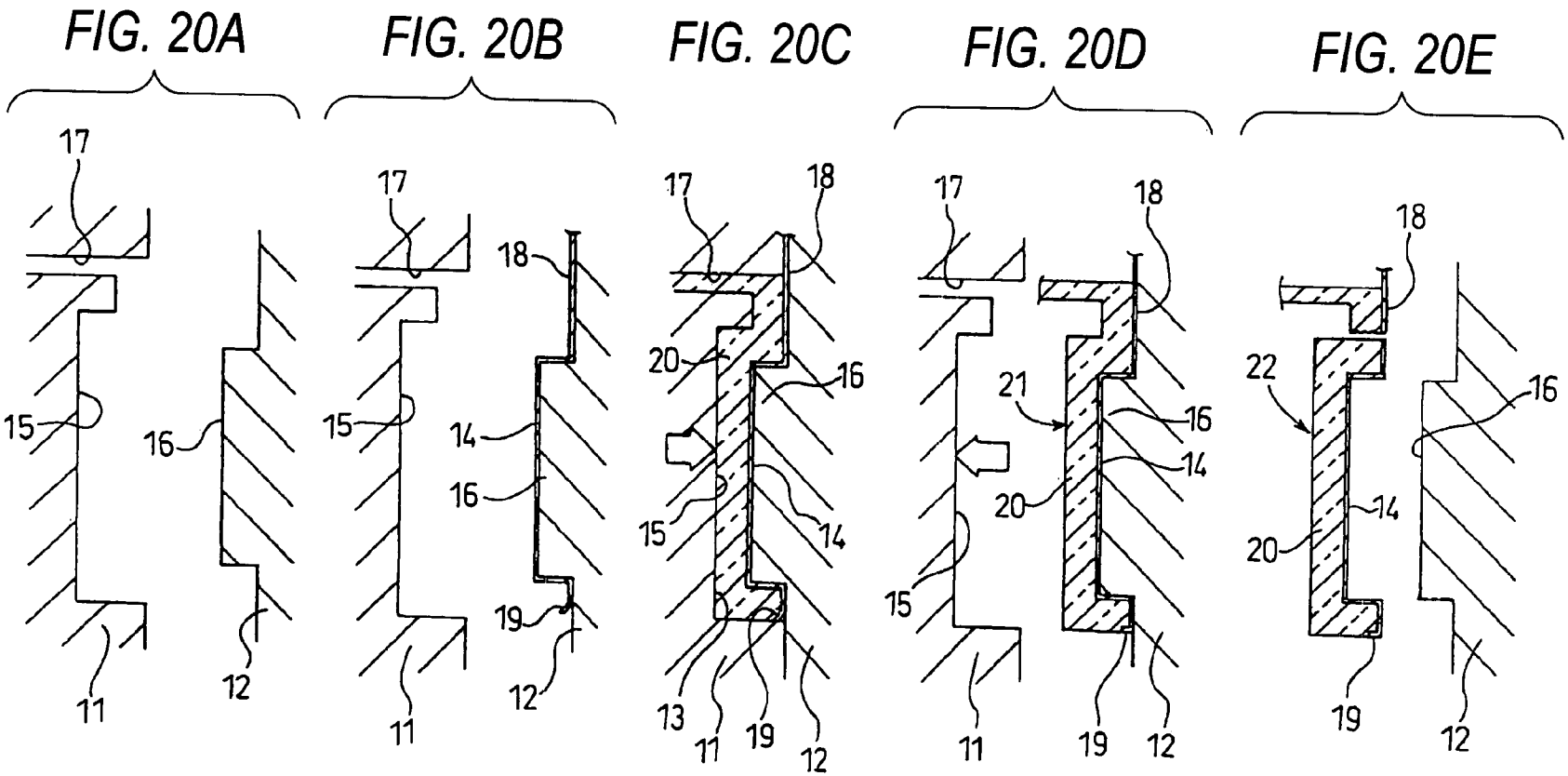
FIG. 20A is a sectional view of a first step of the insert molding method shown in FIG. 19.
FIG. 20B is a sectional view of a second step in the insert molding method shown in FIG. 19.
FIG. 20C is a sectional view of a third step in the insert molding method shown in FIG. 19.
FIG. 20D is a sectional view of a fourth step in the insert molding method shown in FIG. 19.
FIG. 20E is a sectional view of a fifth step in the insert molding method shown in FIG. 19.

As shown in FIG. 20A, in the first step, the upper die 11 is disposed away from the lower die 12.

As shown in FIG. 20B, in the second step, the sheet 14 is disposed on the lower die 12. Here, the extended portion 18 of the sheet 14 is disposed so as to extend toward the end portion of the lower die 12 on the lower die 12. A bent portion 19 is formed on the end portion of the sheet 14 at the side opposite the extended portion 18. The bent portion 19 is not bent into a right angle that coincides with the edge portion of the upper die 11, but is bent into an angle of approximately 45°.

As shown in FIG. 20C, in the third step, the upper die 11 is made to proceed toward the lower die 12 by an upper die shift mechanism (not shown), and when the cavity 13 of a predetermined volume is formed between the lower die 12 and the upper die 11, the progression of the upper die 11 is stopped. The resin material 20 heated to a high temperature is pressurized and supplied to the inside of the cavity 13 from the gate 17 disposed above the extended portion 18 of the sheet 14. Here, as for the resin material 20, a polycarbonate resin of which the molding temperature is 270 to 280° C., the elastic polyethylene terephthalate resin (PET) of which the molding temperature is 240° C. and an acrylonitrile-butadiene-styreneresin (ABS) of which the molding temperature is 230° C. are available. Since the gate 17 is disposed above the extended portion 18, the resin material 20 supplied to the inside of the cavity 13 from the gate 17 is supplied all over the inside of the cavity 13 while pressing the extended portion 18. And the resin material 20 is cooled down at a predetermined time.

In the fourth step, as shown in FIG. 20D, the upper die 11 is made to shift to return by the upper die shift mechanism. Here, the sheet 14 is integrally molded with the resin material 20, and the extended portion 18 is also integrally molded with the resin material 20. Owing to the progression of the pressurized resin material 20, the bent portion 19 of the sheet 14 is molded to a right angle.

In the fifth step, as shown in FIG. 20E, a molded member 21, in which the extended portion 18 of the sheet 14 is integrally mold with the resin material 20, is removed from the lower die 12 knock pin (not shown). The burrs are cut off from the extended portion 18 of the sheet 14 and the gate 17 portion of the resin material 20; thus, the molded article 22 is formed.

As shown in FIG. 21, the extended portion 18 of the sheet 14 is extended to the portion up to the both sides of the gate 18, and the width W thereof (for example, 10 mm) is larger than the inside diameter ϕD (for example, 7 mm) of the gate 17. Owing to this, the pressure force by the resin material 20 supplied from the gate 17 can be received evenly and stably. Owing to this, the sheet 14 is integrally molded at a predetermined position with respect to the resin material 20 with no displacement during the molding.

As shown in FIG. 22 and FIG. 23, in the third step shown in FIG. 20C, the resin material 20 heated to a high temperature is supplied to the inside of the cavity 13 from the gate 17 disposed above the extended portion 18 of the sheet 14. At that time, even the extended portion 18 of the sheet 14 is floated away from the lower die 12 being warped, as the extended portion 18 is supported with pressure by the resin material 20 from the gate 17. Owing to a large pressure force of the resin material 20 from the extended portion 18 side, the sheet 14 reliably comes into close contact with the resin material 20.

According to the insert molding method of the second embodiment, the gate 17*b* for filling the resin material is formed above the extended portion 18 of the sheet 14 extended from the cavity 13. Accordingly, the molding is carried out while the gate 17 depresses the sheet 14. The sheet 14 is correctly positioned and integrally molded without being peeled off or warped; thus, the sheet 14 can be stably molded into a desired configuration.

Also, according to the insert molding method of the second embodiment, the width W of the extended portion 18 of the sheet 14 is formed wider than the diameter ϕD of the gate 17. Accordingly, the pressure force from the gate 17 can be received evenly and stably.

Further, according to the insert molding method of the second embodiment, the pressure force from the gate 17 can be applied to the extended portion 18 of the sheet 14 extended up to the both side portions of the gate 17. Even the temperature of the filled resin material 20 is high, the positioning accuracy of the sheet 14 can be improved.

Figure 24:
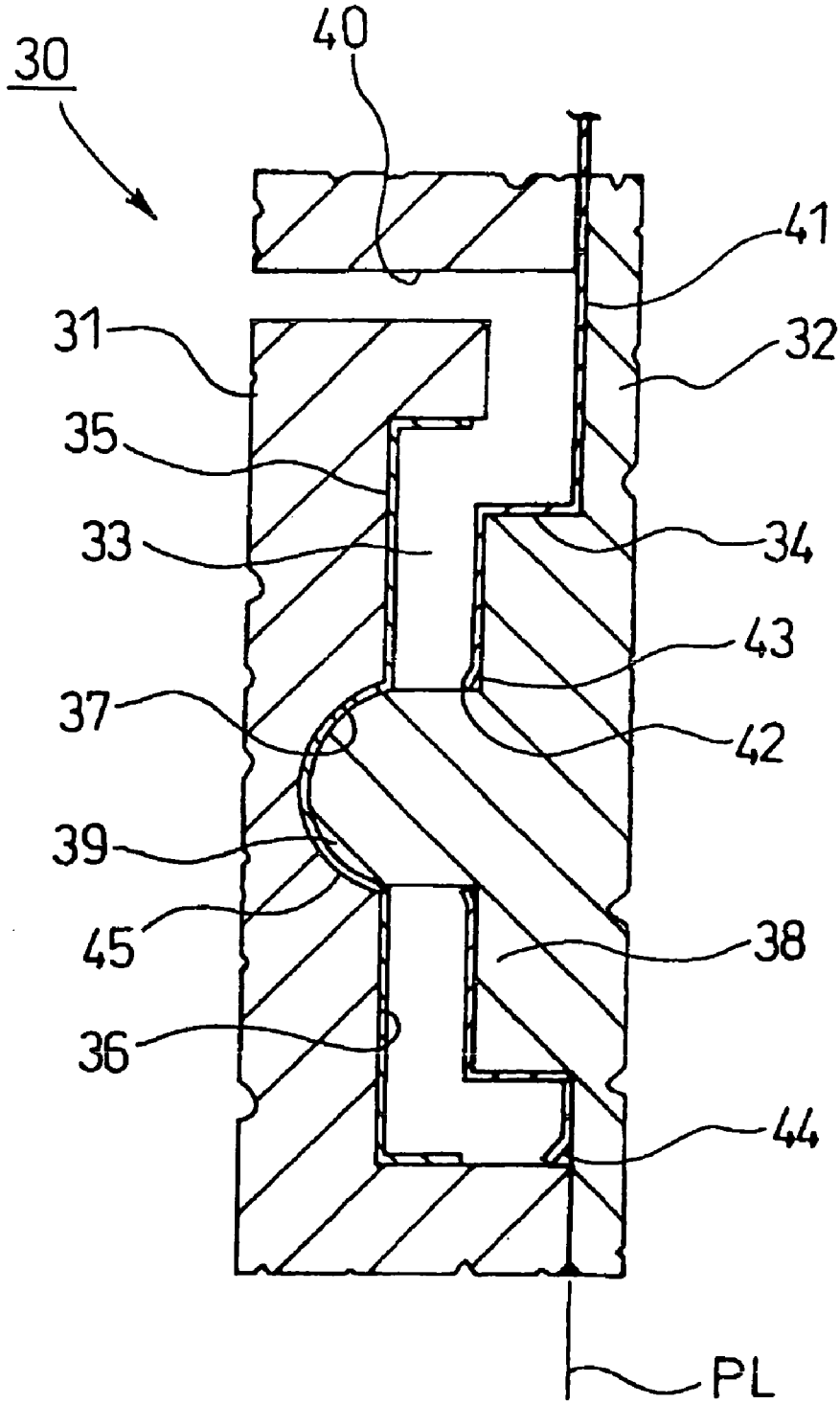
FIG. 24 is a sectional view illustrating an insert molding method of a third embodiment according to the present invention.
Figure 25:
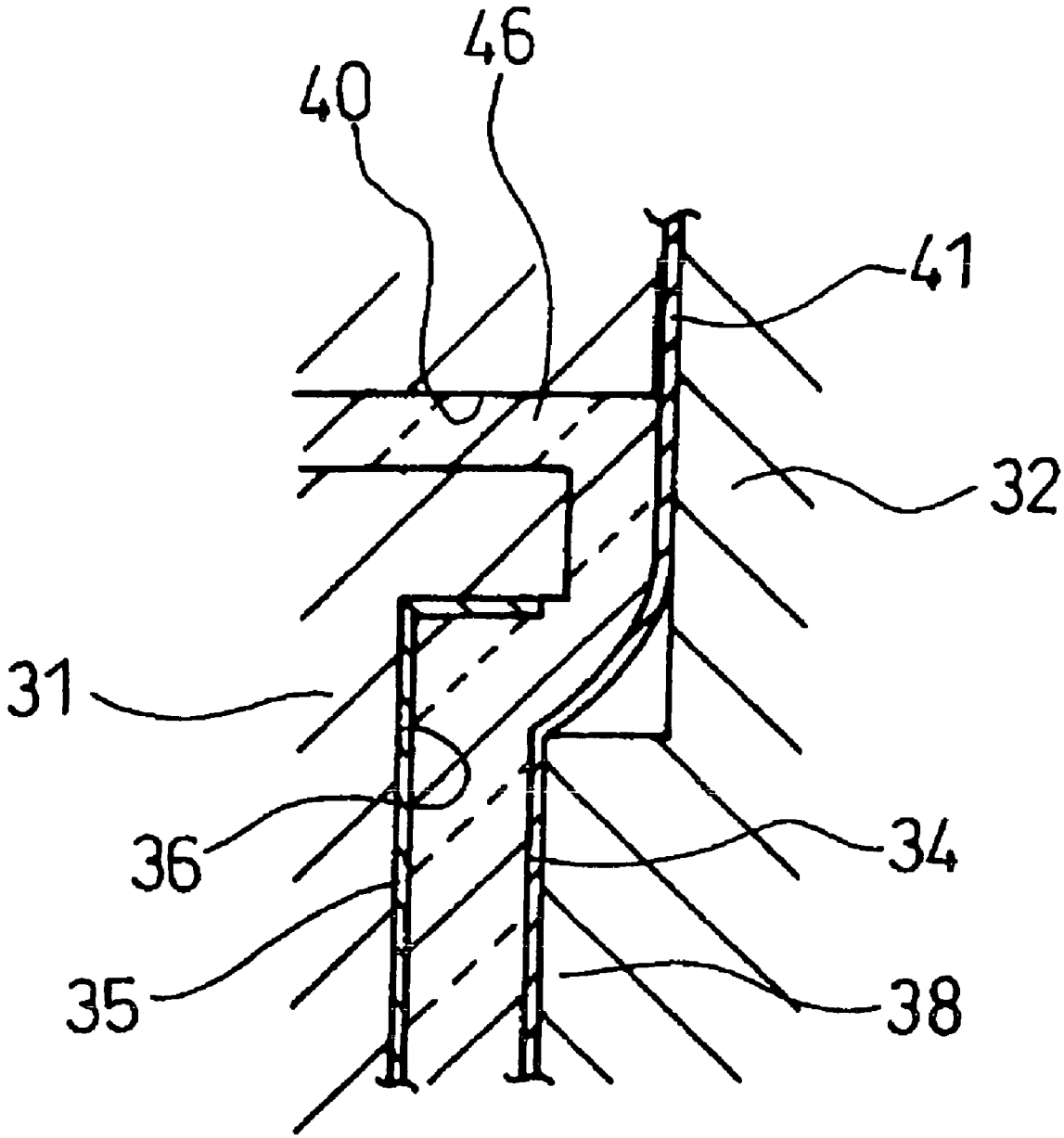
FIG. 25 illustrates a state of the first half of the molding in the insert molding method shown in FIG. 24.
Figure 26:
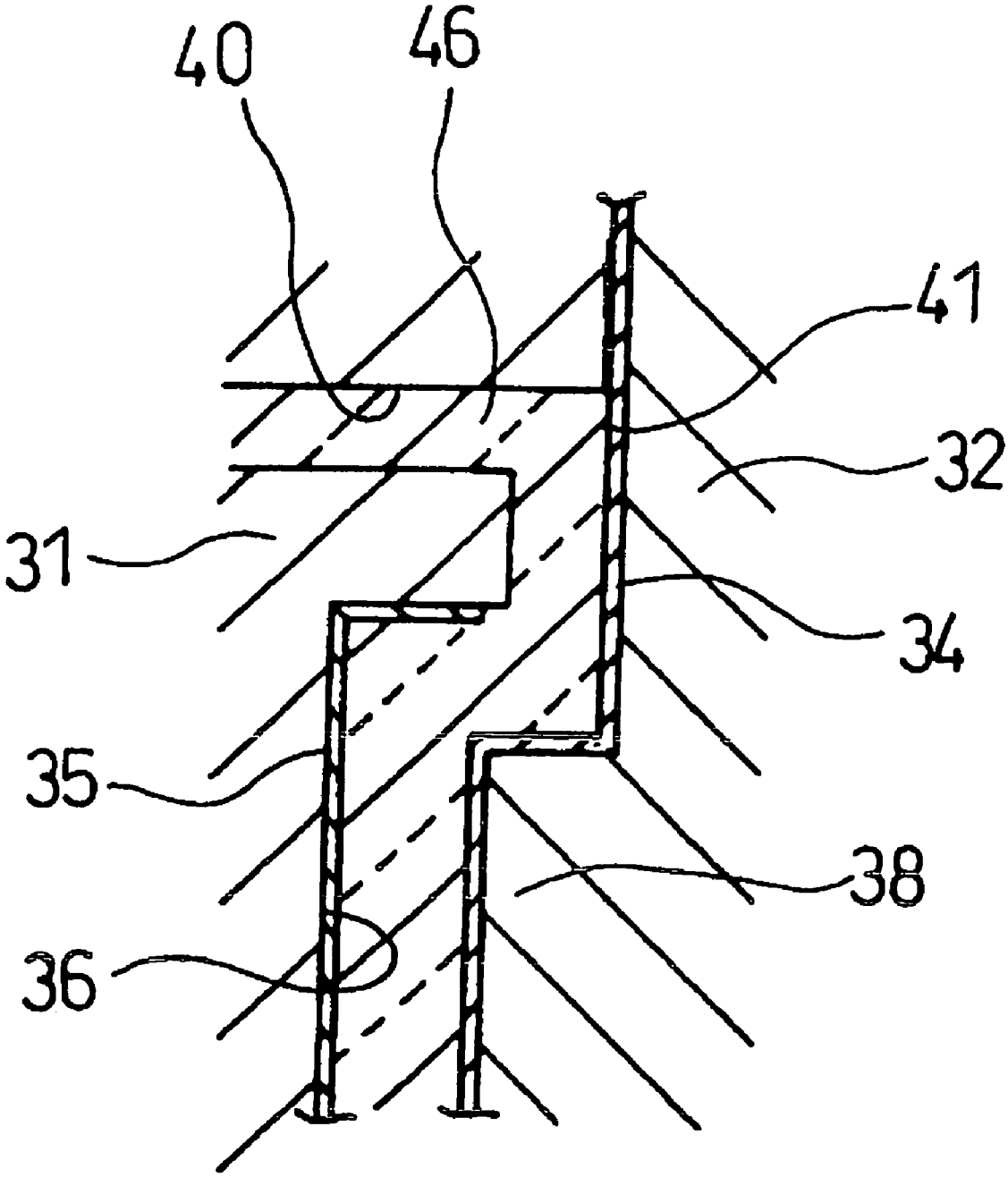
FIG. 26 illustrates a state of the second half of the molding in the insert molding method shown in FIG. 24.
Figure 27:
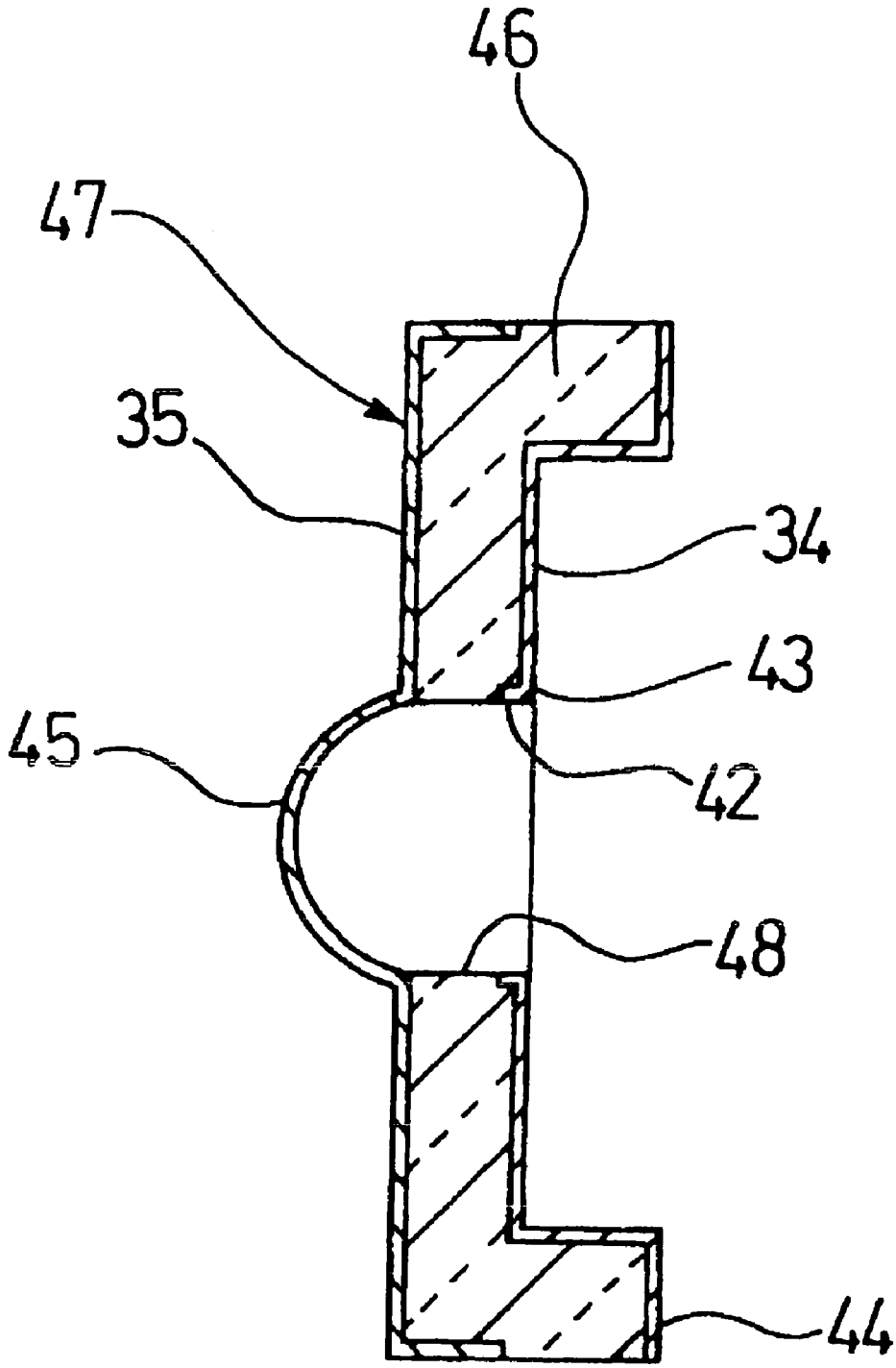
FIG. 27 is a sectional view of a molded article formed by the insert molding shown in FIG. 24.
Figure 28:
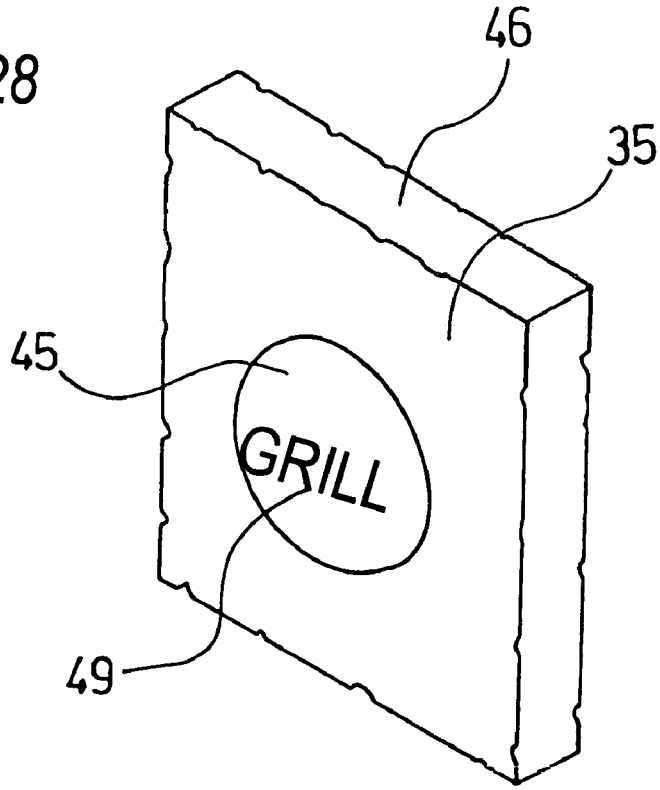
FIG. 28 is an external perspective view of a part taken from a conforming article formed by the insert molding method shown in FIG. 24.
Figure 29:
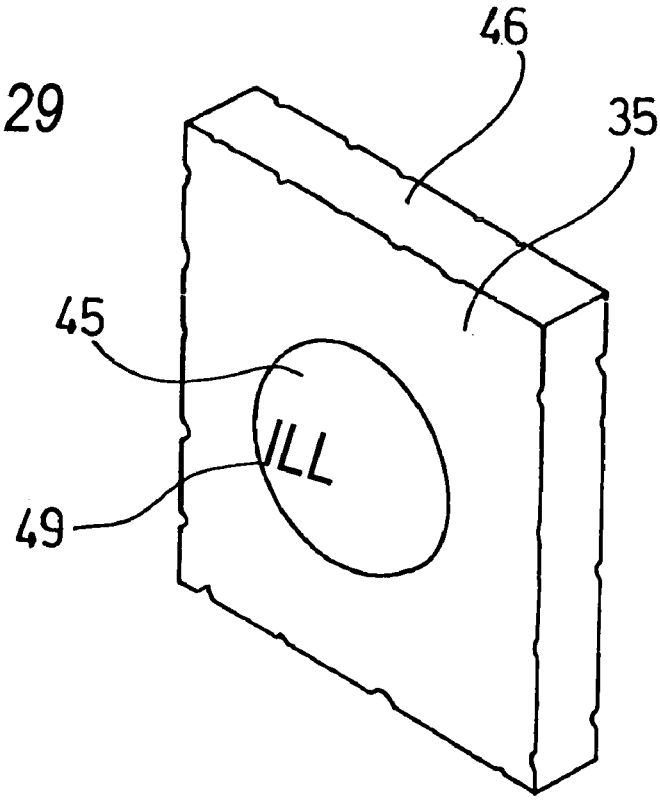
FIG. 29 is an external perspective view of a part taken from a defective article formed by the insert molding method shown in FIG. 24.

Next, the insert molding method of a third embodiment according to the present invention will be described with reference to FIG. 24 to FIG. 35. FIG. 24 is a sectional view illustrating an insert molding method of a third embodiment according to the present invention. FIG. 25 illustrates a state of the first-half of the molding in the insert molding method shown in FIG. 24. FIG. 26 illustrates a state of the second half of the molding in the insert molding method shown in FIG. 24. FIG. 27 is a sectional view of a molded article formed with the insertion molding shown in FIG. 24. FIG. 28 is an external perspective view of a conforming article, partially taken therefrom, which is formed with the insert molding method shown in FIG. 24. And FIG. 29 is an external perspective view of a defective article, partially taken therefrom, which is formed with the insert molding method shown in FIG. 24.

Figure 30:
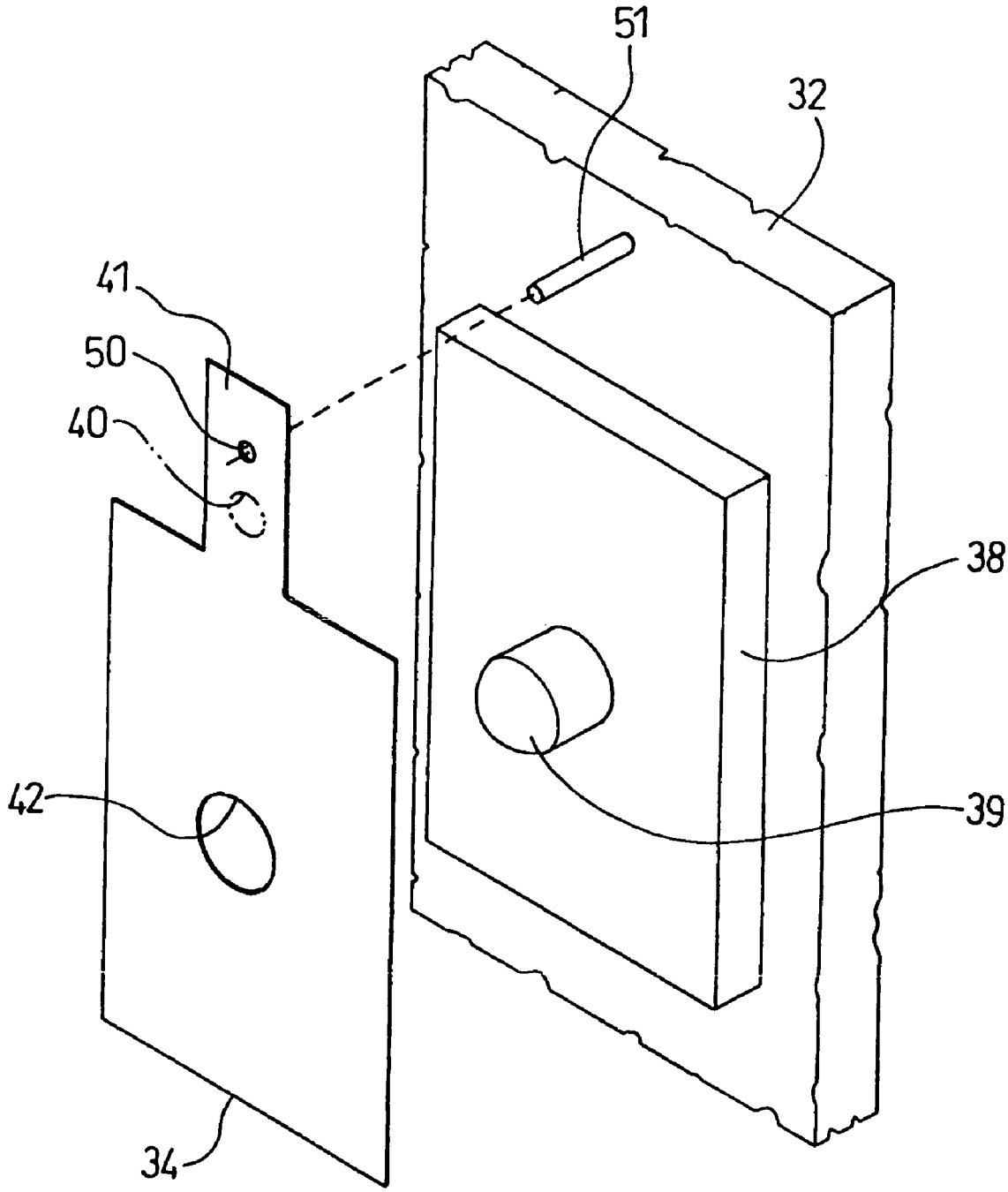
FIG. 30 is a perspective view of the inside of dies, from which the upper die is omitted, in the insert molding method shown in FIG. 24.
Figure 31:
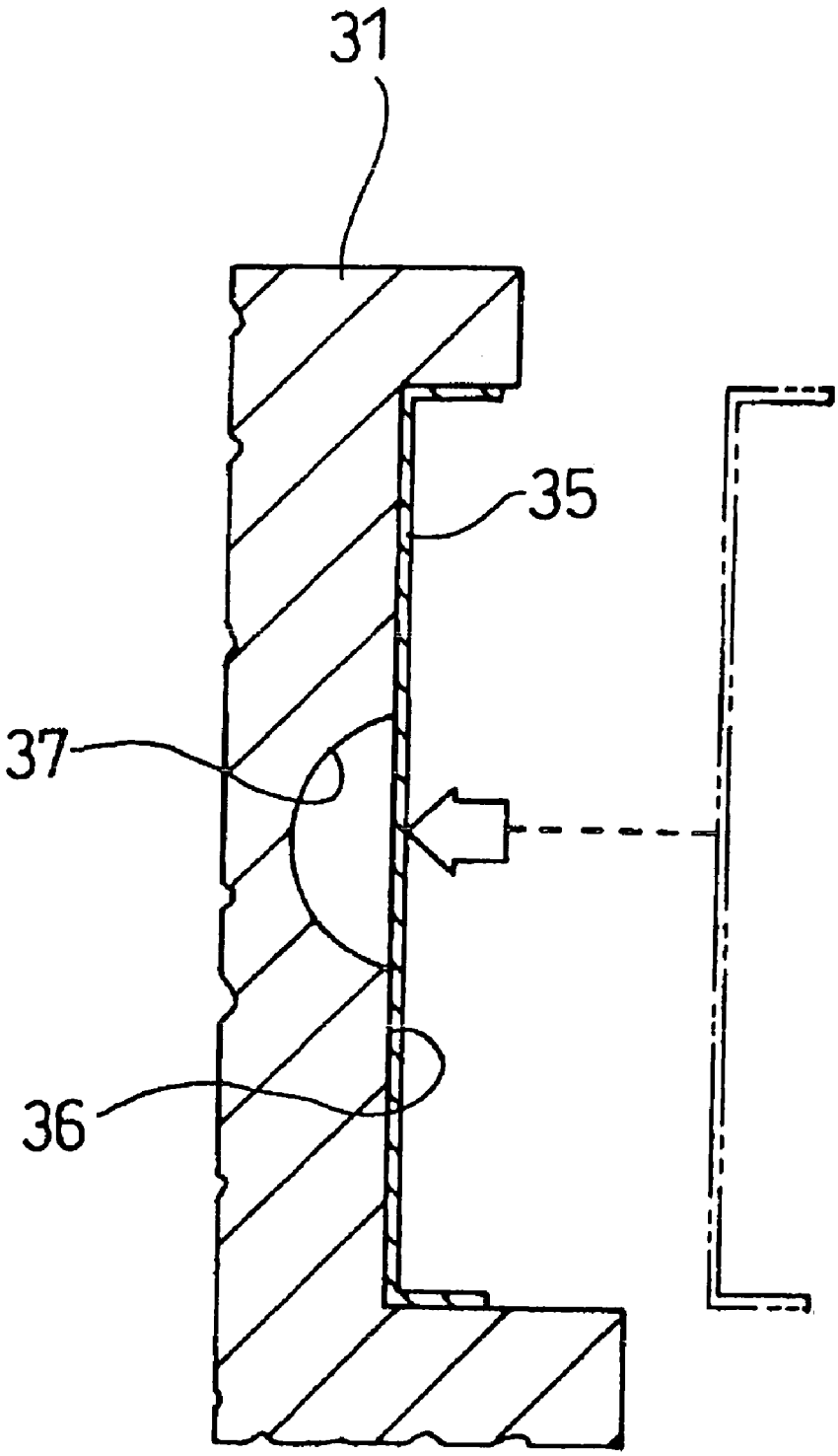
FIG. 31 is a sectional view illustrating the mounting of a sheet in the insert molding method shown in FIG. 24.
Figure 32:
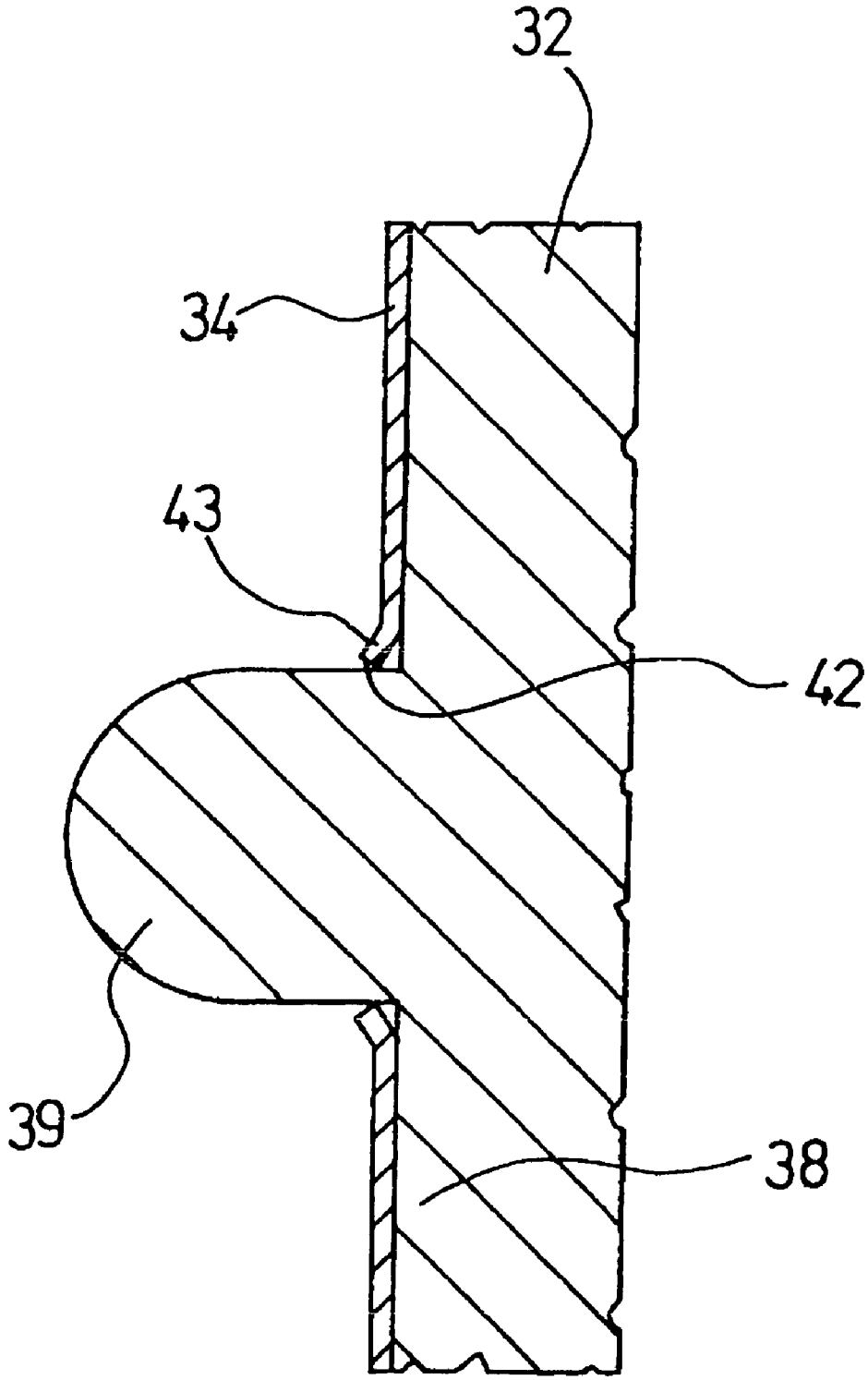
FIG. 32 is a partially enlarged sectional view of the sheet in the insert molding method shown in FIG. 24.
Figure 33:
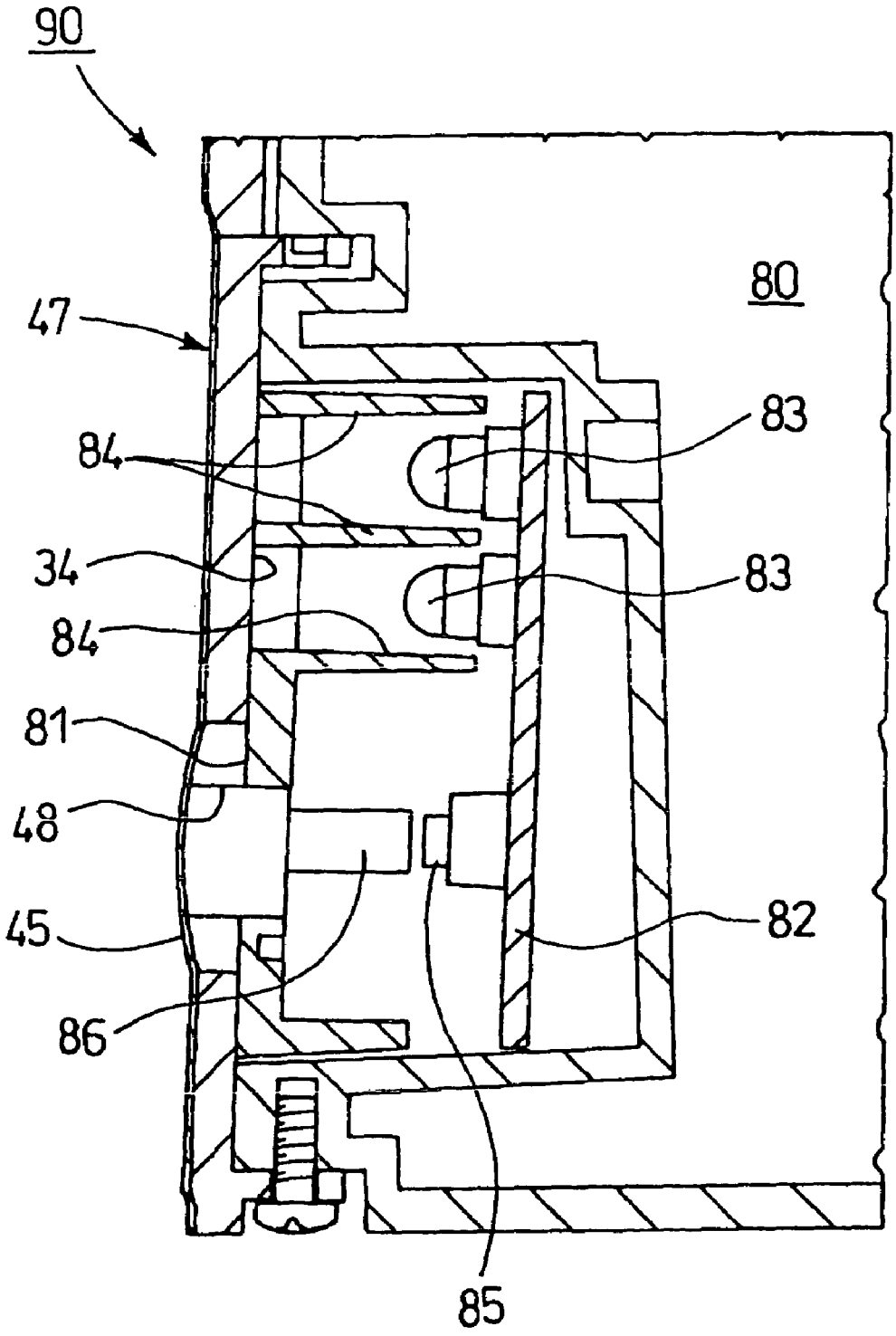
FIG. 33 is an assembly diagram of a molded article formed by the insert molding method shown in FIG. 24.
Figure 34:
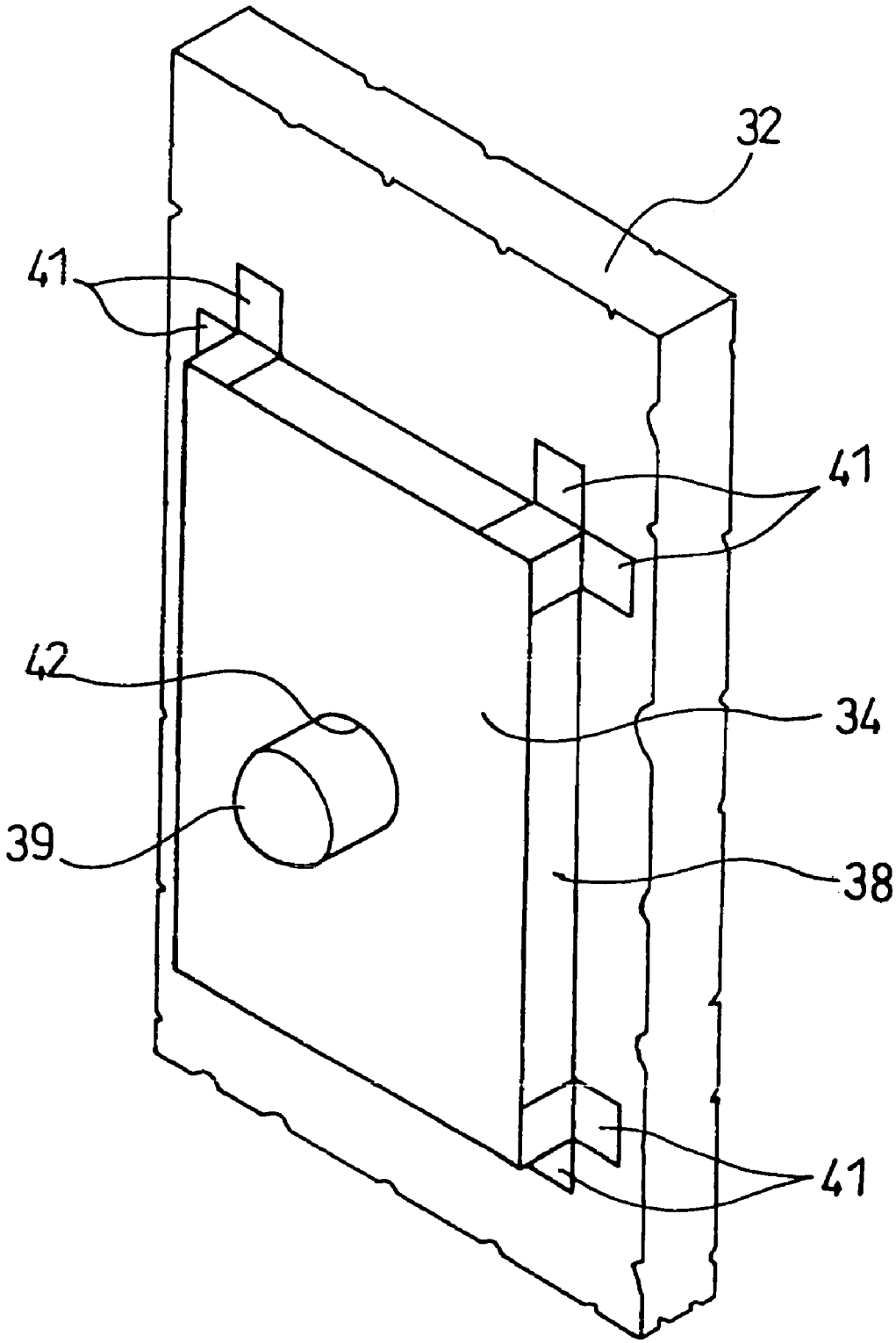
FIG. 34 is an external view showing a modification of a sheet in the insert molding method shown in FIG. 24.
Figure 35:
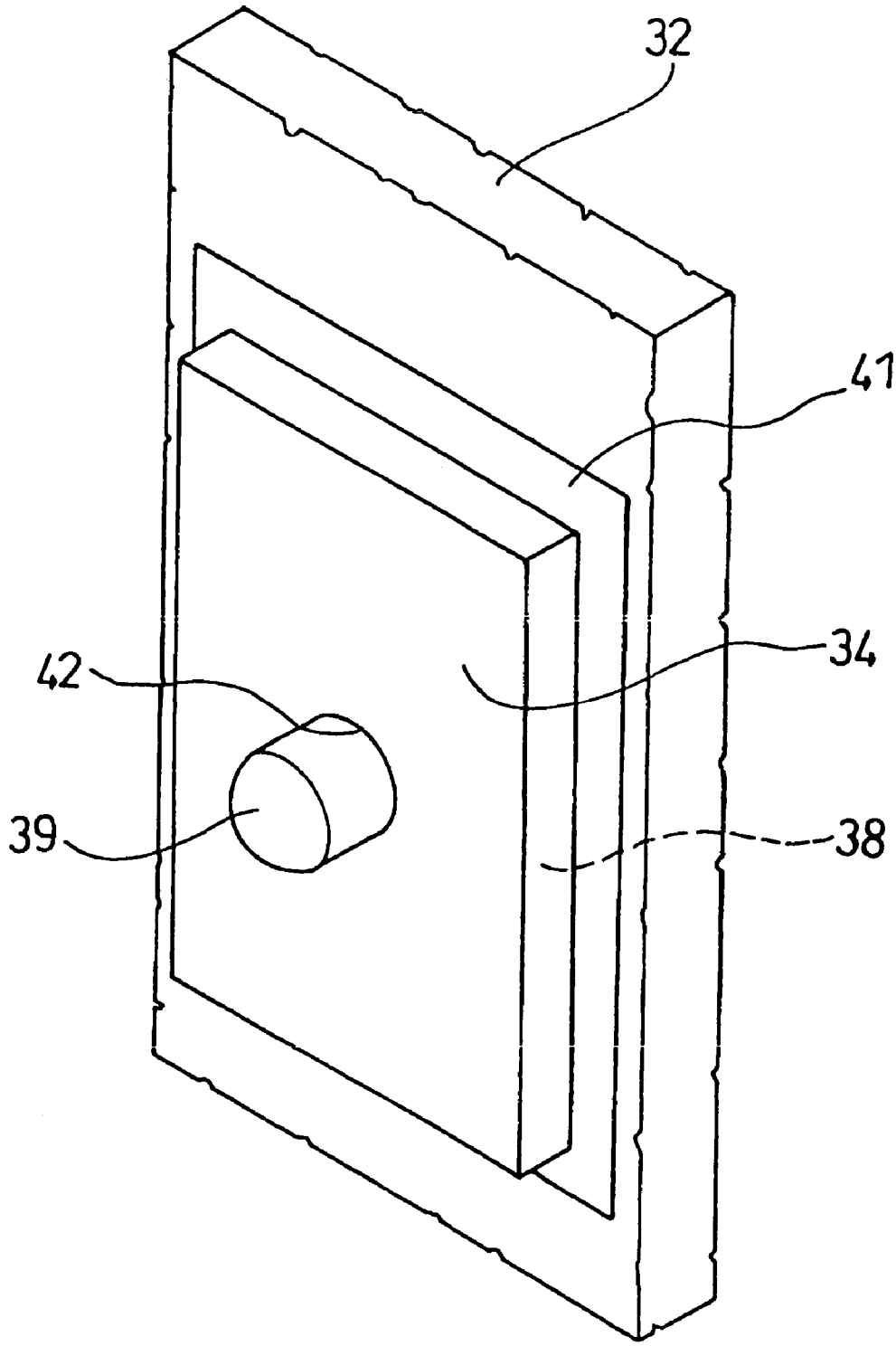
FIG. 35 is an external view showing a modification of a sheet different from that shown in FIG. 34.
Figure 36A:
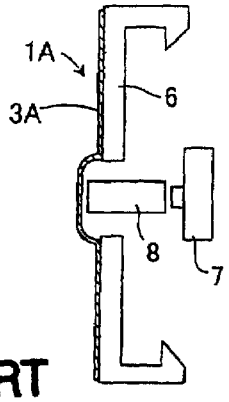
FIGS. 36A and 36B show schematic sectional views of a switch section and a display section of a display panel molded by a conventional front insertion method.
Figure 36B:
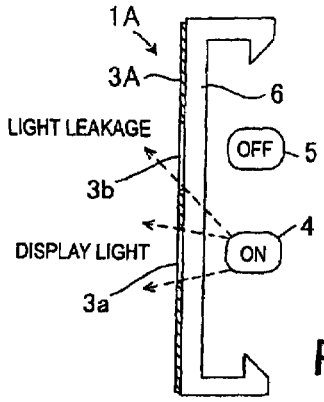
PRIOR ART FIG. 36B
Figure 37A:
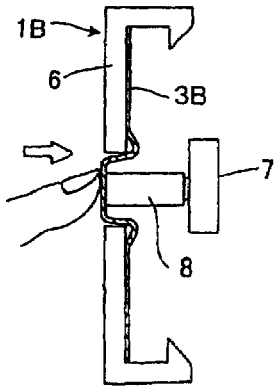
PRIOR ART FIG. 37A
FIGS. 37A and 37B show schematic sectional views of a switch section and a display section of the display panel molded by a conventional rear insertion method.
Figure 37B:
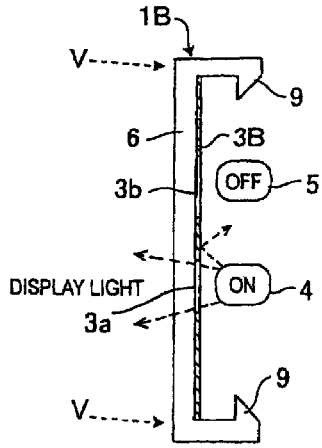
PRIOR ART FIG. 37B
Figure 38A:
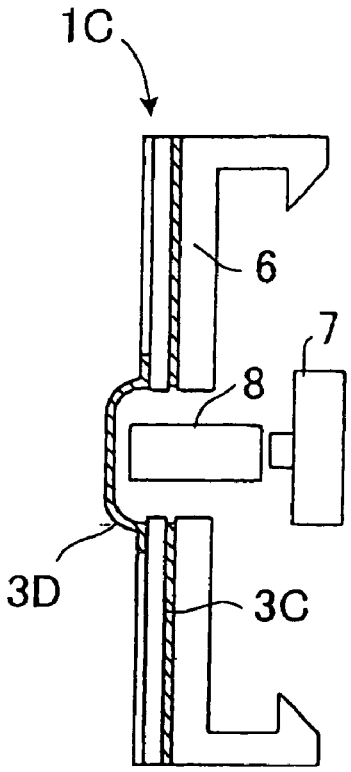
FIGS. 38A and 38B show schematic sectional views of examples of a display panel of a conventional double-layered structure.
Figure 38B:
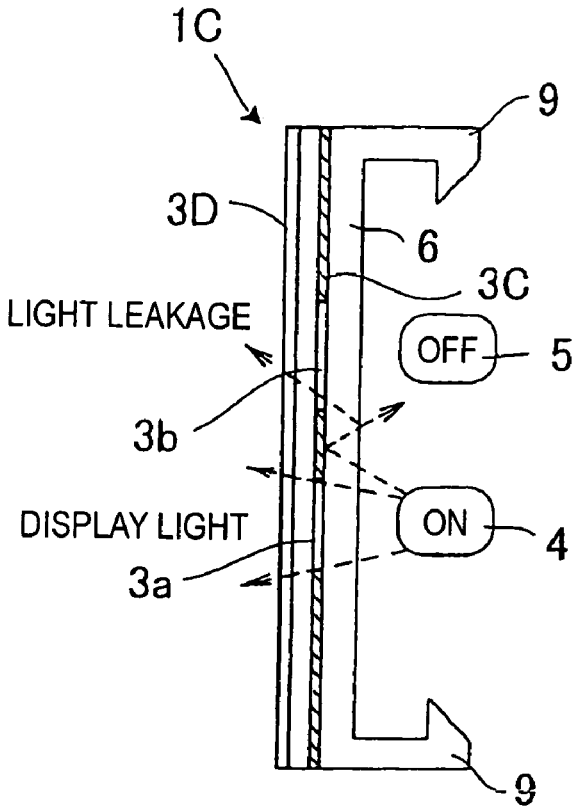

FIG. 30 is a perspective view of the inside of the dies, the upper die of which is omitted, in the insert molding method shown in FIG. 24. FIG. 31 is a sectional view illustrating the mounting of the sheet in the insert molding method shown in FIG. 24. FIG. 32 is a partial enlarged sectional view of the sheet in the insert molding method shown in FIG. 24. FIG. 33 is an assembly diagram of a molded article formed with the insert molding method shown in FIG. 24. FIG. 34 is an external view of a modification of the sheet in the insert molding method shown in FIG. 24. FIG. 35 is an external view showing a modification of a sheet different from the sheet in FIG. 34. As for portions the same or equivalent to those of the second embodiment, description thereof will be omitted or simplified.

As shown in FIG. 24, the insert molding method according to the third embodiment uses a molding machine 30 equipped with an upper die 31 and a lower die 32. A rear sheet 34 is disposed on the lower die 32 side in the cavity 33 formed by the upper die 31 and the lower die 32; and a front sheet 35 is disposed on the upper die 31 side in the cavity 33.

In the upper die 31, a spherical concave portion 37 having a semispherical shape is formed in the central area of the concave portion 36; and in the lower die 32, a spherical convex portion 39 having a semispherical shape, which is disposed facing the spherical concave portion 37, is formed in the central area of the convex portion 38. And between the end portion of the upper die 31 and the end portion of the lower die 32, a gate 40 for filling a resin material is formed. The gate 40 is disposed above the extended portion 41 of the rear sheet 34.

The rear sheet 34 is a plate member of a transparent or semi-transparent resin; in the spherical convex portion 39 portion of the lower die 32, a circular opening 42 is formed, and in the inner edge portion of the opening 42, a bent portion 43 is formed. The bent portion 43 is not bent at a right angle, but bent at an angle of approximately 45°. Further, a bent portion 44 is formed in the end portion of the rear sheet 34 at the side opposite the extended portion 41.

The front sheet 35 is an elastically deformable plate member formed of a transparent or semi-transparent resin. In order to form a cavity 33 of a predetermined volume, a dome-like convex surface portion 45, to which the sheet should be molded as the single state in a state that the upper die 31 progresses toward the lower die 32, is formed.

As shown in FIG. 25 and FIG. 26, when a resin material 46 heated to a high temperature is pressurized and supplied to the inside of the cavity 33 from the gate 40 disposed above the extended portion 41 of the rear sheet 34, even when the extended portion 41 of the rear sheet 34 is warped and lifted away from the lower die 32, since the extended portion 41 is depressed and supported by the resin material 46 from the gate 40, owing to a large pressure force of the resin material 46 from the extended portion 41 side, the rear sheet 34 and the front sheet 35 are reliably closely contacted with the resin material 46.

As shown in FIG. 27, the resin material 46 is pressurized and supplied into the cavity 33 from the gate 40. After cooling down, the dies 31 and 32 are separated. The burrs are cut off from the extended portion 41 of the rear sheet 34 and the portion of the gate 40 in the resin material 46. Thus, the front sheet 34 as the front surface and the rear sheet 35 as the rear surface are integrally molded each being positioned at a predetermined position; thus the molded article 47 is formed. In the molded article 47, since the resin material 46 is not supplied to the rear side of the convex surface portion 45 of the front sheet 35, a cylindrical hole 48 is formed. Here, owing to the progression of the pressurized resin material 46, the bent portion 43 of the rear sheet 34 is molded into a right angle, and the bent portion 44 thereof is molded into a plane. The convex surface portion 45 is used in a state that a movable piece of a switch (shown in FIG. 33) 85 is inserted into the hole 48, and the front end of the movable piece is in contact with the rear surface of the convex surface portion 45.

As shown in FIG. 28, when the molded article 47 is used as a display panel, in the front surface of the convex surface portion 45 in the front sheet 35, a predetermined indicator mark 49 is printed. Therefore, by correctly positioning the front sheet 35 to a predetermined position and integrally molding with the resin material 46, the indicator mark 49 can be disposed in the central area of the convex surface portion 45 in a balanced manner.

As shown in FIG. 29, when the front sheet 35 is molded being incorrectly positioned to a predetermined position, the indicator mark 49 is displaced from the central area of the convex surface portion 45 resulting in a defective product. As described above, when the molded article 47 is used as a display panel, positioning accuracy with respect to the switch, lamps and the like, which are integrally assembled with the display panel, is required. By correctly positioning the front sheet 35 and the rear sheet 34 to a predetermined position of the resin material 46, a high quality molded article 47 with no displacement with respect to the switch, the lamps or the like can be formed.

As shown in FIG. 30, in the extended portion 41 of the rear sheet 34, a supporting hole 50 is formed at an end side position with respect to the position corresponding to the gate 40. The supporting hole 50 is positioned by being inserted with a shaft 51, which is formed projecting on the lower die 32. Ordinarily, holes for suctioning the sheet to hold by a vacuum is formed in the dies. However, in this manner, not only is the sheet flown and shifted in the dies while filling the resin, but also marks are left on the rear surface of the molded article. Therefore, by inserting the shaft 51 into the supporting hole 50, the rear sheet 34 can be positioned at a predetermined position with no displacement.

As shown in FIG. 31, since being molded with the end portion bent, only by being inserted into the concave portion 36 of the upper die 31, the front sheet 35 is positioned. Being elastically deformed into a dome-like shape by the spherical convex portion 39 of the lower die 32, the convex surface portion 45 is formed.

As shown in FIG. 32, the bent portion 43 of the opening 42 in the rear sheet 34 is not bent into a right angle before molding, the bent portion 43 is molded into a right angle by the progression of the pressurized resin material 46.

As shown in FIG. 33, the molded article 47 is used being mounted on an electronic apparatus 80 as a display panel 90. In the electronic apparatus 80, on a circuit board 82 attached to a rear face panel 81, a plurality of LEDs 83 are electrically connected thereto. The plurality of LEDs 83 display a lamp display section, display areas and areas formed by the partition walls 84 formed on the rear sheet 34 separately. A movable piece 86 of the switch 85 is inserted into the hole 48 in the convex surface portion 45, the front end of the movable piece 86 comes into contact with the rear surface of the convex surface portion 45. In the electronic apparatus 80, by depressing the convex surface portion 45 the movable piece 86 is shifted to make the switch 85 operate the switching.

Next, referring to FIG. 34, a modification of a supporting method in the rear sheet 34 will be described.

As shown in FIG. 34, in this modification, on the periphery portion of the rear sheet 34 a plurality of extended portions 41, for example eight extended portions, are formed. Therefore, owing to the plurality of extended portions 41, the supporting force is given to the gate 40 evenly. Thus, the positioning accuracy can be further increased.

Next, referring to FIG. 35, another modification of the supporting method in the rear sheet 34 is described.

As shown in FIG. 35, according to this modification, an integrally extended portion 41 is formed on the whole circumference in the periphery portion of the rear sheet 34 at the lower die 32 side. Accordingly, owing to the extended portion 41 disposed on the whole circumference, the supporting force by the gate 40 is further improved. Thus, the positioning accuracy can be further improved According to the insert molding method of the third embodiment, double-faced insert molding, in which the rear sheet 34 and the front sheet 35 disposed at the both sides of the cavity 33 are integrally molded reliably, is carried out.

Also, according to the insert molding method of the third embodiment, by using a molded article 47 for the display panel 90 having the switch 85, a display panel in which the rear sheet 34 and the front sheet 35 are integrally molded reliably and is molded into a stable configuration, can be formed.

There is a case where two one-sided insert molded parts are joined being overlapped with each other. In such a case, the external configurations of both molded articles are hardly made to coincide with each other and a gap may be accordingly generated therebetween after being overlapped with each other. Thus, it is difficult to join the molded articles with high accuracy and high yield. However, by carrying out the present invention, a highly accurate joining can be carried out while aligning the external configurations of the molded articles with no gap.

The present invention is not limited to the above-described embodiments, but may be appropriately changed, modified or the like.

For example, basically, a single gate will do. However, taking into consideration the displacement of the resin material, a plurality of gates may be additionally formed. In such a case also, it is preferable that the gates are disposed above the extended portion of the sheet.

Although the invention has been illustrated and described for the particular preferred embodiments, it is apparent to a person skilled in the art that various changes and modifications can be made on the basis of the teachings of the invention. It is apparent that such changes and modifications are within the spirit, scope, and intention of the invention as defined by the appended claims.

The present application is based on Japan Patent Application No. 2004-039446 filed on Feb. 17, 2004 and Japan Patent Application No. 2004-143224 filed on May 13, 2004, the contents of which are incorporated herein for reference.

What is claimed is:

1. A display panel which is adapted to be mounted on an electronic apparatus, comprising:

a first printed sheet, wherein the first printed sheet includes a first base and a first printed area formed on the first base, and the first printed area has at least one of a character and an image;

a transparent material layer provided on the first printed sheet; and a second printed sheet provided on the transparent material layer so as to be opposed to the first printed sheet, wherein the second printed sheet includes a second base and a second printed area formed on the second base, and the second printed area has at least one of a character and an image;

wherein the first printed sheet, the transparent material layer and the second printed sheet are integrally formed to each other; and wherein the second printed area is viewable from the first printed sheet side through the transparent material layer.

2. The display panel as set forth in claim 1, wherein the first base has translucency.

3. The display panel as set forth in claim 1, wherein the second base has translucency.

4. The display panel as set forth in claim 1, wherein the transparent material layer has a first through hole;

wherein the second printed sheet has a second through hole that is communicated with the first through hole; and wherein the first printed sheet has a single sheet layer at an area facing to the first through hole.

5. The display panel as set forth in claim 4, wherein the area of the single sheet layer in the first sheet is subjected to an embossment processing.

6. The display panel as set forth in claim 1, wherein at least a part of the first printed area is processed with a medium printing having a light diffusion feature.

7. The display panel as set forth in claim 1, wherein at least a part of the second printed area is processed with a medium printing having a light diffusion feature.

8. The display panel as set forth in claim 1, further comprising an engagement portion for fixing the display panel, wherein the engagement portion is formed at a periphery of the transparent material layer; and wherein the first printed area of the first printed sheet has an opaque area that is arranged so as to be opposed to the engagement portion.

9. The display panel as set forth in claim 1, further comprising a bended portion formed on at least a part of a periphery of the transparent material layer, wherein in the bended portion, an end portion of at least one of the first printed sheet and the second printed sheet is extended from a surface of the transparent material layer toward a side end surface of the transparent material layer.

10. The display panel as set forth in claim 1, further comprising a rib portion, and a bended portion formed on at least the surface of the rib portion, wherein the rib portion is provided on a periphery of the transparent material layer so as to protrude toward the second printed sheet side;

wherein a surface of the rib portion is connected to a surface of the transparent material layer; and wherein in the bended portion, an end portion of at least one of the first printed sheet and the second printed sheet is extended from a surface of the transparent material layer toward a side end surface of the transparent material layer.

11. The display panel as set forth in claim 1, further comprising a projection portion, an opening portion, and a bended portion formed at a periphery of the projection portion, wherein the projection portion is provided on the transparent material layer;

wherein the opening portion is provided on at least one of the first printed sheet and the second printed sheet so as to expose the projection portion through the opening portion; and wherein in the bended portion, an end portion of a periphery of the opening portion of at least one of the first printed sheet and the second printed sheet is extended along a side surface of the projection portion of the transparent material layer.

12. A control display panel, comprising:

a display panel according to any one of claims 4 to 11;

a switch pressing member that is disposed in the first and second through hole; and a switching unit that performs a switching operation by receiving an operation in which the switch pressing member is depressed through the single sheet layer of the first printed sheet.

13. The control display panel as set forth in claim 12, wherein the first printed area of the first printed sheet has an opaque area.

14. A control display panel, comprising:

a display panel according to any one of claims 6 to 11, and a light source that is disposed at the second printed sheet side of the display panel, wherein the second printed area is formed on the second printed sheet so as to be opposed to an irradiation position of the light source; and wherein the second printed area includes an area processed with a medium printing having a light diffusion feature.

* * * * *

UNITED STATES PATENT AND TRADEMARK OFFICE

CERTIFICATE OF CORRECTION

PATENT NO. : 7,598,926 B2
APPLICATION NO. : 11/059586
DATED : October 6, 2009
INVENTOR(S) : Junji Hirata et al.

It is certified that error appears in the above-identified patent and that said Letters Patent is hereby corrected as shown below:

In the specification, column 2, line 16, please replace the "," with --.--,

In the specification, column 10, line 60, please remove the ".",

In the specification, column 14, line 63, please insert a --.-- after the word "Ld", In the specification, column 15, line 42, please insert a --,-- after the number "117".

Signed and Sealed this

Fifth Day of January, 2010

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,598,926 B2
APPLICATION NO. : 11/059586
DATED : October 6, 2009
INVENTOR(S) : Hirata et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 947 days.

Signed and Sealed this

Twenty-eighth Day of September, 2010

David J. Kappos

David J. Kappos
*Director of the United States Patent and Trademark Office*